US006122469A

United States Patent [19]

Miura et al.

[11] Patent Number: 6,122,469

[45] Date of Patent: Sep. 19, 2000

[54] IMAGE FORMING APPARATUS INCLUDING A PREVENTING MECHANISM FOR PREVENTING A DEVELOPING UNIT FROM ROTATING

[75] Inventors: Tetsuro Miura; Satoshi Hatori, both of Tokyo; Kazuyuki Sugihara; Tomoji Ishikawa, both of Kanagawa; Yoshiyuki Kimura, Tokyo; Kenji Maeda, Kanagawa, all of Japan

[73] Assignee: Ricoh Company, Ltd., Tokyo, Japan

[21] Appl. No.: 09/207,764

[22] Filed: Dec. 9, 1998

[30] Foreign Application Priority Data

| | | | |
|---|---|---|---|
| Dec. 9, 1997 | [JP] | Japan | 9-361890 |
| Feb. 18, 1998 | [JP] | Japan | 10-052785 |
| Mar. 6, 1998 | [JP] | Japan | 10-071243 |
| Oct. 30, 1998 | [JP] | Japan | 10-311462 |

[51] Int. Cl.[7] ..... G03G 15/01; G03G 15/06

[52] U.S. Cl. ..... 399/227

[58] Field of Search ..... 399/227

[56] References Cited

U.S. PATENT DOCUMENTS

| | | | |
|---|---|---|---|
| 3,987,756 | 10/1976 | Katayama et al. | 399/227 |
| 4,743,938 | 5/1988 | Ohno | 399/227 |
| 4,975,748 | 12/1990 | Koinuma et al. . | |
| 5,105,226 | 4/1992 | Sugihara . | |
| 5,109,254 | 4/1992 | Oka et al. . | |
| 5,168,319 | 12/1992 | Kimura et al. | 399/227 |
| 5,227,842 | 7/1993 | Hayashi et al. . | |
| 5,325,151 | 6/1994 | Kimura et al. | 399/227 |
| 5,331,390 | 7/1994 | Kimura et al. | 399/227 |
| 5,384,628 | 1/1995 | Takami et al. . | |
| 5,416,568 | 5/1995 | Yoshiki et al. . | |
| 5,552,877 | 9/1996 | Ishikawa et al. . | |
| 5,565,973 | 10/1996 | Fujishiro et al. . | |
| 5,617,198 | 4/1997 | Ishikawa et al. . | |
| 5,646,721 | 7/1997 | Sugihara et al. . | |
| 5,655,190 | 8/1997 | Fuchiwaki | 399/227 |
| 5,758,235 | 5/1998 | Kosuge et al. . | |
| 5,761,576 | 6/1998 | Sugihara et al. . | |
| 5,765,059 | 6/1998 | Kosuge et al. . | |
| 5,768,664 | 6/1998 | Kosuge et al. . | |
| 5,784,669 | 7/1998 | Miura et al. . | |
| 5,787,328 | 7/1998 | Sugihara et al. . | |
| 5,850,586 | 12/1998 | Sugihara et al. . | |

FOREIGN PATENT DOCUMENTS

| | | |
|---|---|---|
| 60-208779 | 10/1985 | Japan . |
| 61-77873 | 4/1986 | Japan . |
| 61-103175 | 5/1986 | Japan . |
| 61-151564 | 7/1986 | Japan . |
| 62-251772 | 11/1987 | Japan . |
| 63-178262 | 7/1988 | Japan . |
| 5-94086 | 4/1993 | Japan . |
| 9-114180 | 5/1997 | Japan . |
| 10-142941 | 5/1998 | Japan . |

*Primary Examiner*—William J. Royer

*Attorney, Agent, or Firm*—Oblon, Spivak, McClelland, Maier & Neustadt, P.C.

[57] ABSTRACT

An image forming apparatus including a development unit rotatably supported by a body of the apparatus and including a plurality of developing subunits and a plurality of replaceable developer containers each storing a developer to be replenished to a particular one of the developing subunits. Also included is a stepping motor configured to cause the developing unit to rotate in order to bring any one of the developing subunits to a developing position, a preventing mechanism configured to prevent the developing unit from rotating at a time of replacement of any one of the developer containers due to an unexpected change in a voltage or a current driving the stepping motor, and a locking portion included in either one of the developing unit and the body and an engaging portion included in the other of the developing unit and the body, in which the locking portion and the engaging portion selectively engaging with each other for preventing the developing unit from rotating. Further included is a door member opened when any one of the developer containers is to be removed from the apparatus or closed when development is under way. The locking portion and the engaging portion engaging with each other in mechanically interlocked relation to an opening movement of the door member. Also included is a moving device configured to cause the locking portion to engage with the engaging portion by mechanically interlocking the opening movement of the door member to a movement of the locking portion.

16 Claims, 28 Drawing Sheets

IMAGE FORMING APPARATUS INCLUDING A PREVENTING MECHANISM FOR PREVENTING A DEVELOPING UNIT FROM ROTATING

BACKGROUND OF THE INVENTION

The present invention relates to a copier, facsimile apparatus, printer or similar image forming apparatus and more particularly to an image forming apparatus of the type including a revolver type developing unit adjoining an image carrier and having a plurality of developing sections arranged around a center shaft thereof.

An image forming apparatus of the type described and capable of sequentially locating a plurality of developing sections at a preselected developing position is disclosed in, e.g., Japanese Patent Laid-Open Publication No. 8-6467. The prerequisite with this type of apparatus is that the developing sections be sequentially brought to and accurately positioned at the developing position. To meet this requirement, a developing unit including the developing sections may be driven by a stepping motor. A stepping motor can have its rotation angle delicately control led on the basis of a reference position and the number of pulses to be applied to the motor. With a stepping motor, therefore, it is possible to accurately position any one of the developing sections at the developing position without resorting to any mechanical positioning scheme.

The above mechanical positioning scheme may be implemented by notches formed in the circumferential edge of the rear end wall of the developing unit and respectively assigned to the developing sections, and a roller rotatably mounted on the apparatus body. The roller engages with one of the notches when the subunit corresponding to the notch is brought to the developing position. For accurate positioning, the developing unit may be rotated by an angle greater than an angle necessary for one notch to meet the roller and then rotated in the reverse direction. This, however, increases the angular distance over which the developing unit should move, and therefore increases the positioning time. While a solenoid may be applied to the mechanical positioning scheme, the solenoid needs an extra start-up time.

Therefore, a stepping motor used to position the developing unit alone is advantageous over the mechanical positioning scheme from the high speed operation stand point also.

Toner cartridges each storing toner of particular color are also mounted to the developing unit, and each feeds the respective toner to an associated one of the developing sections. When a toner near-end condition is sensed in any one of the developing sections and when the associated toner cartridge is empty, the cartridge is replaced with a full toner cartridge.

In the apparatus of the type positioning the developing unit only with a stepping motor, when the feed of current to the motor is stopped while image formation is not under way, the developing unit originally freely rotatable in the apparatus is made entirely free and can be rotated even by hand. This brings about a problem that when the operator inserts a new toner cartridge into a particular developing section in the developing unit at the time of replacement, the developing unit rotates and prevents the outlet of the cartridge from aligning with the above developing section. As a result, toner or the cartridge itself is apt to drop.

In light of the above, Japanese Patent Laid-Open Publication No. 10-260581, for example, teaches an image forming apparatus including a stepping motor for rotating a developing unit having a plurality of developing sections and a plurality of replaceable developer containers. At the time of replacement of any one of the developer containers, the phase of the stepping motor is continuously excited such that the motor exerts on the developing unit a force preventing the unit from being rotated by an unexpected extraneous force. By preventing the developing unit from rotated during replacement, it is possible for the operator to surely replace a desired developer container.

However, the problem with the above apparatus taught in Laid-Open Publication No. 10-260581 is that throughout the replacement of the developer container performed by the operator, a current is continuously fed to the stepping motor which originally should drive the developing unit. As a result, when a current or a voltage driving the motor sharply changes due to, e.g., an accidental change in a signal for commanding the rotation of the motor, the developing device in the form of a revolver is apt to suddenly start rotating.

To promote the high speed operation of the above apparatus, it is necessary to load the developing device with a great amount of developer and a great amount of toner, increasing the overall weight and size of the device and therefore the moment of inertia. It follows that a stepping motor free from the loss of synchronism, or step-out, must be used. However, a stepping motor obviating defective images ascribable to step-out despite heavy loads and high speed rotation is not feasible for general purpose applications and is therefore extremely expensive. This, coupled with the fact that the stepping motor needs an AC power source, complicates the construction and makes it difficult to mount the motor on a copier, printer or similar office equipment. It is therefore difficult to enhance high speed operation. While the voltage or the current for driving the motor and therefore the output torque of the motor may be increased, this kind of approach aggravates power consumption.

It has been customary with the image forming apparatus to transmit the output torque of the stepping motor mounted on the apparatus body to the center shaft of the developing unit via a plurality of intermeshing gears. On the other hand, during image formation, the developing unit is rotated only in one direction and, in principle, not rotatable in the other direction. However, because play ascribable backlash exists between the intermeshing gears, the developing unit is likely to slightly rotate in the reverse direction, resulting in defective images.

Technologies relating to the present invention are also taught in, e.g., Japanese Patent Laid-Open Publication Nos. 10-142941, 60-208779, 61-103175, 61-151564, 10-114180, 61-077873, 62-251772, 63-178262, and 5-94086.

SUMMARY OF THE INVENTION

It is therefore an object of the present invention to provide an image forming apparatus promoting the positive replacement of a developer container by preventing a developing unit from rotating due to an unexpected change in a voltage or a current driving a stepping motor.

It is another object of the present invention to provide an image forming apparatus capable of freeing a drive source from step-out without increasing the cost or sophisticating the construction and thereby coping with heavy loads and high-speed operation while saving energy.

It is a further object of the present invention to provide an image forming apparatus capable of obviating play ascribable to backlash between intermeshing gears and thereby insuring high quality images.

In accordance with the present invention, an image forming apparatus includes a developing unit rotatably supported by the body of the apparatus and including a plurality of developing subunits and a plurality of replaceable developer containers each storing a developer to be replenished to a particular one of the developing subunits. A stepping motor causes the developing unit to rotate in order to bring any one of the developing subunits to a developing position. A preventing mechanism prevents the developing unit from rotating at the time of replacement of any one of the developer containers due to an unexpected change in a voltage or a current driving the stepping motor.

Also, in accordance with the present invention, an image forming apparatus includes a plurality of developing subunits. A rotary support body is rotatable while supporting the developing subunits for bringing any one of the developing subunits to a preselected developing position facing an image carrier. A first drive source causes the rotary support body to rotate. A controller controls the first drive source such that the rotary support body rotates for locating any one of the developing subunits at the developing position while being accelerated until the rotary support body reaches a preselected speed, and is then decelerated to a stop to thereby locate the developing subunit at the developing position. Further a second drive source capable of meshing with a drive input gear included in the developing subunit is located at the developing position to thereby transmit a drive force to an image forming member included in the developing subunit. The drive force is transmitted to the drive input gear in a direction counter to the direction of rotation of the rotary support body. The interval between the time when the rotary support body rotating at the preselected speed begins to be decelerated and the time when the rotary support body stops rotating is shorter than the interval between the time when the rotary support body held in a halt begins to move and the time when the rotary support body reaches the preselected speed.

Further, in accordance with the present invention, an image forming apparatus includes a plurality of developing subunits. A rotary support body is rotatable while supporting the developing subunits for bringing any one of the developing subunits to a preselected developing position facing an image carrier. A first drive source causes the rotary support body to rotate. A controller controls the first drive source such that the rotary support body rotates for locating any one of the developing subunits at the developing position while being accelerated until the rotary support body reaches a preselected speed, and is then decelerated to a stop to thereby locate the developing subunit at the developing position. Further, a second drive source capable of meshing with a drive input gear included in the developing subunit is located at the developing position to thereby transmit a drive force to an image forming member included in the developing subunit. The drive force is transmitted to the drive input gear in a direction conforming to the direction of rotation of the rotary support body. The interval between the time when the rotary support body held in a halt begins to rotate and the time when the rotary support body reaches the preselected speed is shorter than the interval between the time when the rotary support body rotating at the preselected speed begins to be decelerated and the time when the rotary support body stops rotating.

Moreover, in accordance with the present invention, an image forming apparatus includes an image carrier rotatable in one direction. A developing unit is rotatable about its center shaft and includes a plurality of developing subunits arranged around the center shaft. The developing unit is rotated in a preselected direction for locating any one of the developing subunits at a preselected developing position facing the image carrier to thereby develop a latent image formed on the image carrier. A one-way clutch is mounted on the center shaft of the developing unit for preventing the developing unit from rotating in a direction opposite to the preselected direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, problems with conventional image forming apparatuses will discussed first.

Figure 22:
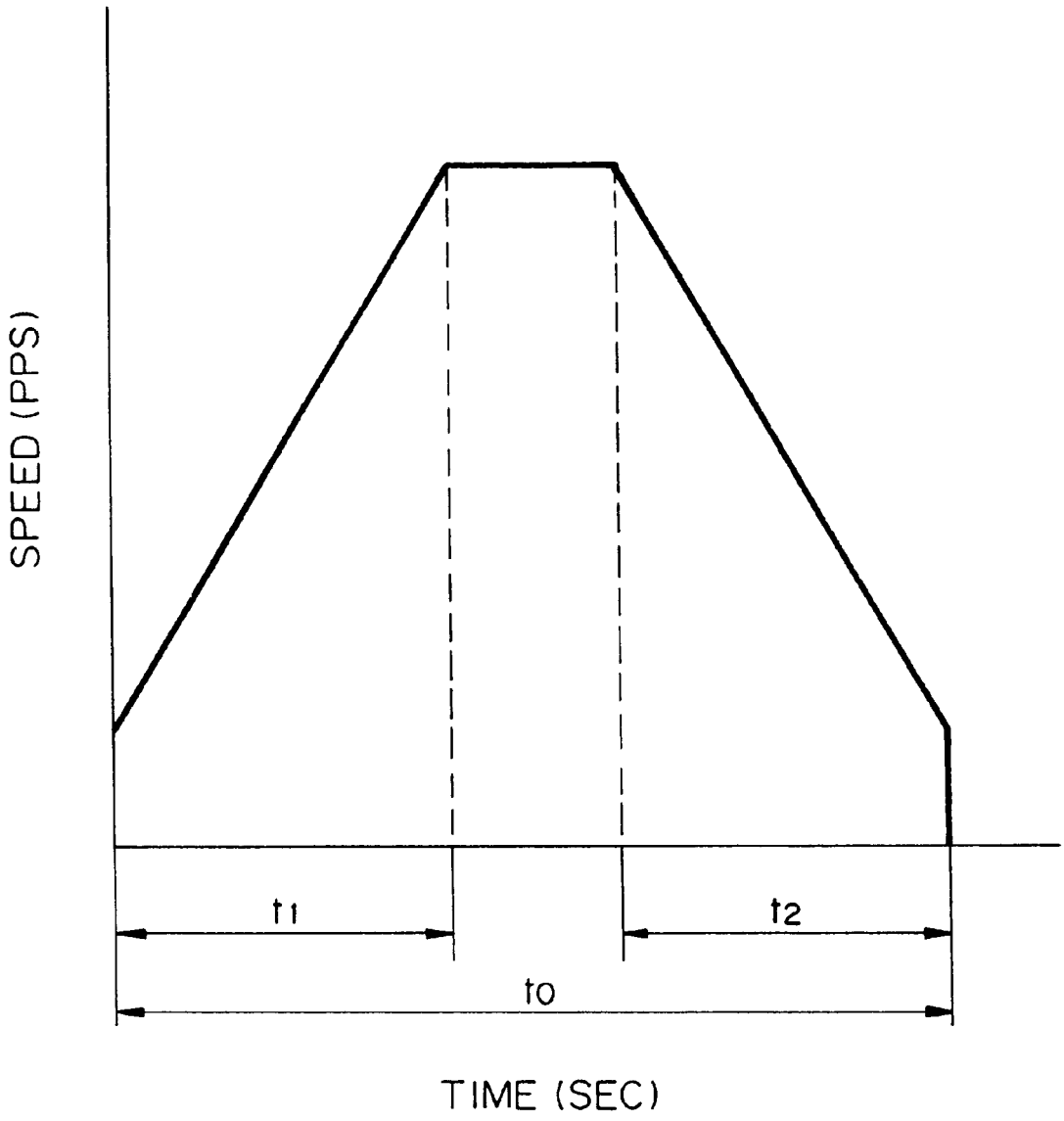
Fig. 22 PRIOR ART
FIG. 22 shows a drive pattern particular to a conventional printer for driving a developing unit.

Assume a revolver type developing device having a plurality of developing units arranged thereinside and rotated by 90° at a time by a stepping motor. FIG. 22 shows a drive pattern generally applied to the stepping motor. As shown, a period of time $t_1$ for acceleration and a period of time $t_2$ for deceleration are equal to each other. The speed as well as other factors is selected such that the developing device completes a preselected angle of rotation within a preselected period of time $t_0$. To reduce the period of time $t_0$, the maximum speed may be increased while maintaining the same acceleration rate and deceleration rate, or the acceleration rate and deceleration rate may be increased while maintaining the maximum speed. The former scheme, however, reduces a margin as to the load torque (required torque) because the torque available with a stepping motor sharply decreases at speeds higher than a certain speed. The latter scheme also reduces a margin as to the load torque because an increase in acceleration rate directly translates into an increase in the load torque to act on the motor. In any case, when the load torque exceeds the torque available with the motor, the motor is brought out of synchronism (step-out) and cannot be rotated by a desired angle. As a result, at the time of color switching, the next developing section is brought to a stop at a position deviated from a preselected developing position and fails to develop a latent image.

However, a stepping motor obviating defective images ascribable to step-out despite heavy loads and high-speed rotation is not feasible for general purpose applications and is therefore extremely expensive, as stated earlier. This gives rises to various problems discussed previously.

It has been customary with the image forming apparatus to transmit the output torque of the stepping motor mounted on the apparatus body to the center shaft of the developing unit via a plurality of intermeshing gears. However, because play ascribable backlash exists between the intermeshing gears, the developing unit is apt to slightly rotate in the reverse direction, resulting in defective images, as also discussed earlier.

How a defective image occurs in the conventional image forming apparatus will be described with reference to FIG. 29. As shown, a developing section 2 is one of developing sections arranged in a developing unit 4. That is, three other developing sections, not shown, are arranged around a center shaft 3*a* at angular intervals of 90°. The developing unit 4 with the four developing sections is rotatable about the center shaft 3*a*. To rotate the developing unit 4, a stepping motor 45 is energized. The output torque of the stepping motor 45 is transmitted to the center shaft 3*a* via a drive gear 48 and a revolver gear 43 meshing with the drive gear 48 and affixed to the center shaft 3*a*. As a result, the developing unit 4 is caused to rotate counterclockwise, as viewed in FIG. 29.

Figure 29:
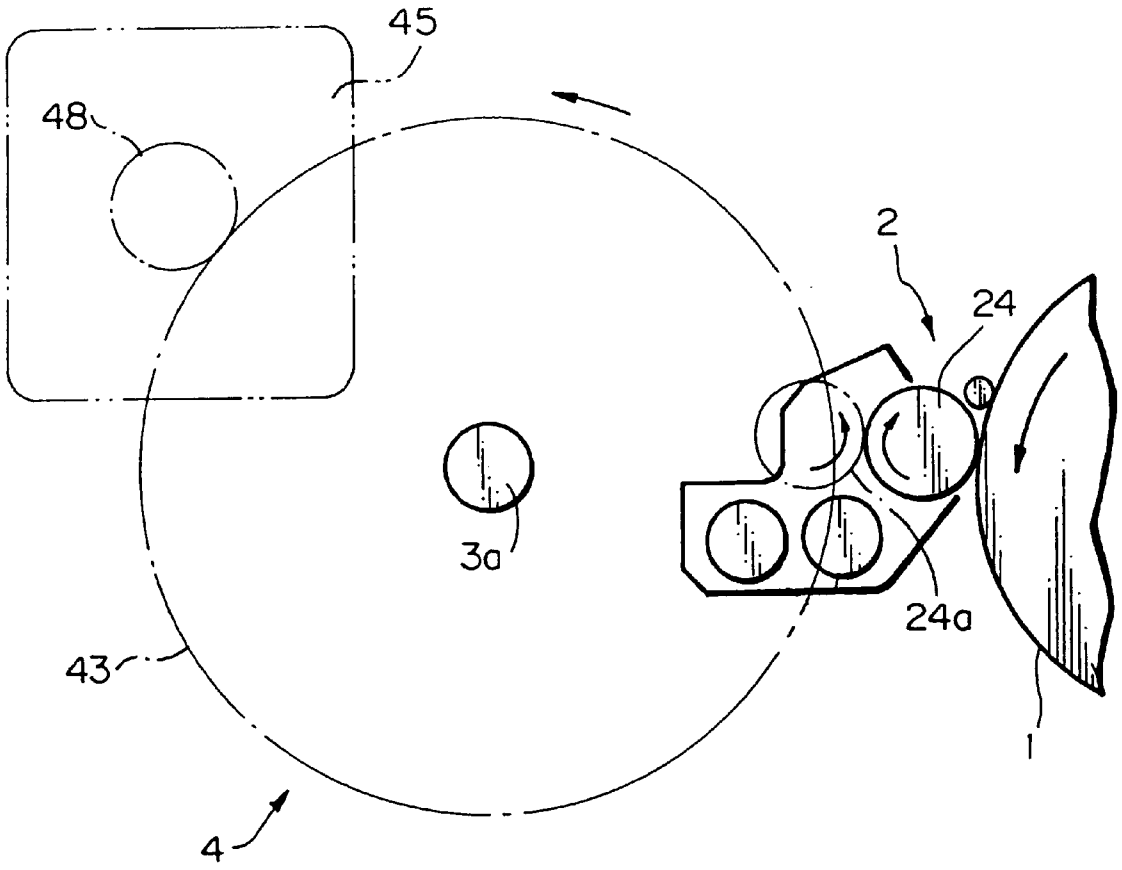
Fig. 29 PRIOR ART
FIG. 29 shows how a defective image occurs in a conventional image forming apparatus.

While the developing section 2 is in operation, the stepping motor 45 is energized in order to temporarily stop the rotation of the developing unit 4, as shown in FIG. 29. It will be seen that although the drive gear 48 is held in a halt, some play ascribable to backlash exists at a position F where the drive gear 48 meshes with the revolver gear 43. The developing unit 4 is therefore not fully locked in position, but has some play in the direction of rotation.

While the developing section 2 is in operation, the developing unit 4 tends to rotate counterclockwise, as viewed in FIG. 29, due to the drive transmission from the drive gear 24*a* rotating counterclockwise to a developing roller 24. On the other hand, because a photoconductive drum 1 rotating counterclockwise faces the developing roller 24 via the developer, it tends to rotate the developing unit 4 clockwise. Such intermittent variations in the torques opposite in direction to each other, coupled with the play ascribable to backlash, cause the developing unit 4 to finely oscillate in the circumferential direction. The oscillation results in a defective image pitching in the horizontal direction.

Preferred embodiments of the image forming apparatus in accordance with the present invention will be described hereinafter. The image forming apparatus is implemented as a color electrophotographic printer by way of example.

First Embodiment

Figure 1:
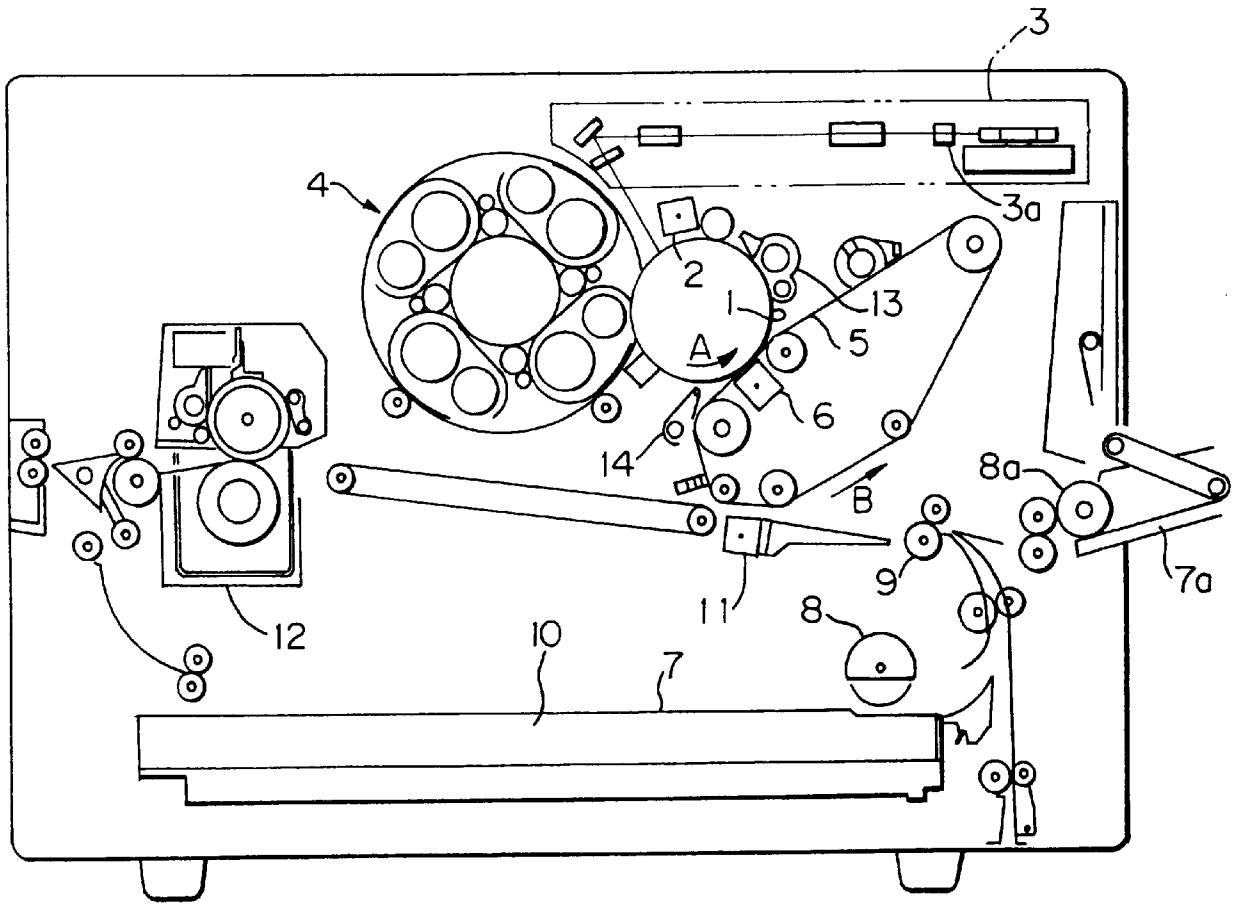
FIG. 1 shows the general construction of a first embodiment of the image forming apparatus in accordance with the present invention.

Referring to FIG. 1, a color electrophotographic printer includes an image carrier in the form of a photoconductive drum 1. While the drum 1 is rotated in a direction indicated by an arrow A, a main charger or main charging means 2 uniformly charges the surface of the drum 1. Laser optics 3 scans the charged surface of the drum 1 in accordance with image data, thereby electrostatically forming a latent image on the drum 1. The image data is single color image data produced by separating a desired full-color image into yellow, magenta, cyan and black color data. A revolver type developing device 4, which will be described later, develops the latent image with preselected one of yellow toner, magenta toner, cyan toner and black toner to thereby form a corresponding toner image. In this manner images of different colors are sequentially formed on the drum 1.

An intermediate transfer belt 5 is rotated in a direction indicated by an arrow B in synchronism with the drum 1. A primary transfer charger 6 sequentially transforms a yellow, a magenta, a cyan and a black toner image sequentially formed on the drum 1 to the intermediate transfer belt 5 one above the other. As a result, a composite color image is formed on the belt 5. A paper or similar recording medium 10 is fed from a duplex copy/auto paper feed cassette 7 by a pick-up roller 8 or from a manual feed tray 7*a* by a pick-up roller 8*a* to an image transfer station via a registration roller 9. A secondary transfer charger 11 located at the image transfer station transfers the color image from the belt 5 to the paper 10. A fixing unit 12 fixes the color image on the paper 10. Finally, the paper 10 with the color image is driven out of the printer as a full-color printing.

The toner left on the drum 1 after the image transfer to the belt 5 is removed by a drum cleaner 13. Likewise, the toner left on the belt 5 after the image transfer to the paper 10 is removed by a belt cleaner 14.

A front door, not shown, is openably mounted on the front of the printer body and opened at the time of toner replenishment or maintenance. When the front door is opened, the inside of the printer is exposed to the outside.

Figure 2:
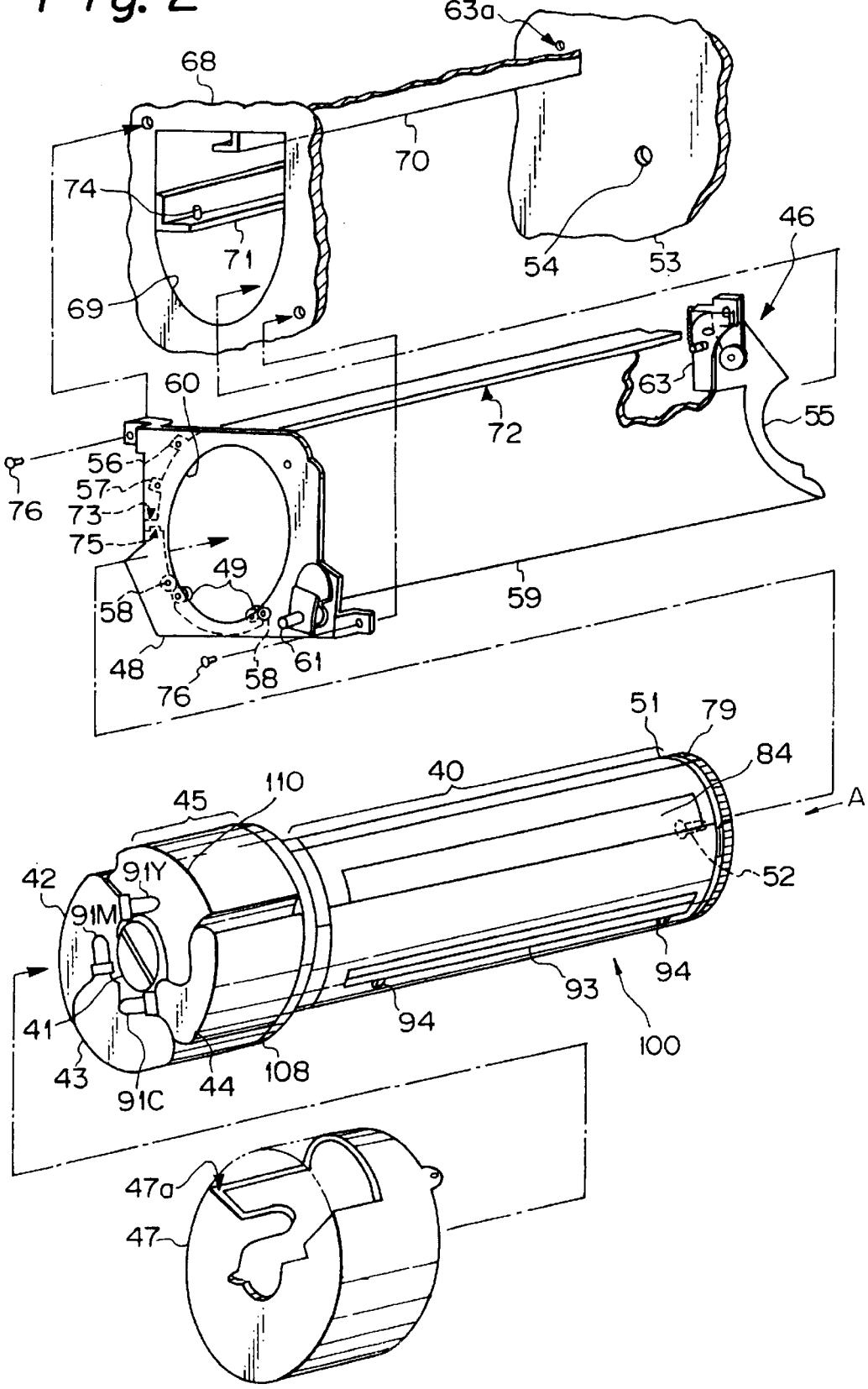
FIG. 2 is an exploded perspective view showing a revolver type developing device included in the first embodiment.
Figure 3A:
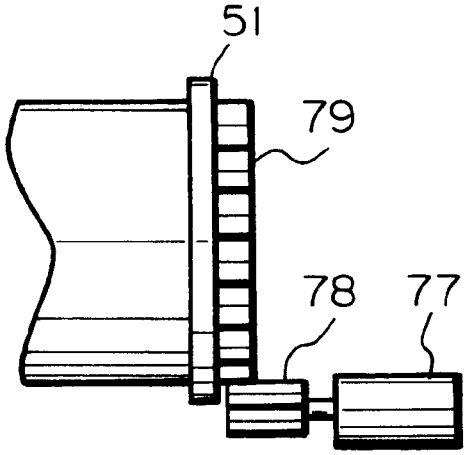
FIG. 3A is a fragmentary enlarged view of a rear plate included in the developing device of FIG. 2.
Figure 3B:
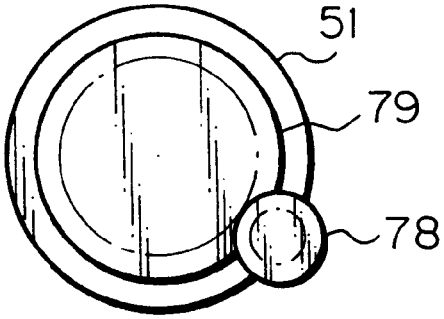
FIG. 3B is a view of a developing unit included in the developing device, as seen in a direction A of FIG. 2.

FIG. 2 shows the revolver type developing device 4 in detail. As shown, the developing device includes a revolver 100 made up of a developing unit 40 and a toner storing unit 45. The developing unit 40 has a substantially cylindrical cross-section and is rotatable about its axis. Developing chambers respectively assigned to, e.g., black, cyan, yellow and magenta are formed in the developing unit 40. The toner storing unit 45 holds four toner containers 41, 42, 43 and 44 respectively storing black toner, yellow toner, magenta toner and cyan toner and corresponding one-to-one to the developing chambers. The toner storing unit 45 is positioned at the front of and substantially coaxially with the developing unit 40 and rotatable integrally with the developing unit 40. A base 46 supports the revolver 100 and is mounted on the printer body in such a manner as to be slidable substantially in parallel to the above axis. An unrotatable cover 47 covers the toner storing unit 45.

Two support rollers 49, for example, are rotatably mounted on a front support plate 48 included in the base 46. A disk-like front wall included in the developing unit 40 is supported by the support rollers 49. A tapered center shaft 52 extends out from the center of a disk-like rear wall 51 also included in the developing unit 40. The center shaft 52 is rotatably received in a hole 54 formed in a rear side wall 53 forming a part of the printer body. In this condition, as shown in FIG. 1, the revolver 100 is rotatable with its axis of rotation lying in substantially the same horizontal plane as the axis of rotation of the drum 1. The axis of the revolver 100 is parallel to the axis of the drum 1.

The base 46 has, in addition to the front support plate 48, a rear support plate 55, tie bars 56, 57 and 58 affixed to the support plates 48 and 55 at their opposite ends, and a side cover 59 reinforced by the tie bars 56–58. An opening 60 is formed in the front support plate 48 for receiving the revolver 100. A motor 61 and a gear train, not shown, driven by the motor 61 are mounted on the front support plate 48 together with the support rollers 49. The motor 61 drives toner replenishing rollers, which will be described later, included in the toner storing unit 45.

A front side wall 68 forming another part of the printer body is formed with an opening 69 for receiving the base 46 carrying the revolver 100 therewith. An upper guide 70 and a lower guide 71 extend between the front side wall 68 and the rear side wall 53 for slidably supporting the base 46. The side cover 59 of the base 46 includes portions 72 and 73 to be guided by the guides 70 and 71, respectively. An upright guide pin 74 is studded on the guide 71 and received in a pin groove 75 formed in the underside of the portion 73 which is positioned at the side of the cover 59. In this configuration, the base 46 can be moved into and out of the printer body, as needed.

A pin having a tapered end is studded on an intermediate plate 63 supported by the base 46. Just before the base 46 is fully inserted into the printer body, the tapered end of the pin begins to enter a positioning hole 63*a* formed in the rear side wall 53 of the printer body. When the base 46 is fully inserted into the printer body, the rear support plate 55 of the base 46 is accurately positioned within the printer body via the pin. After the insertion of the base 46 into the printer body, the front support plate 48 is fastened to the front side wall 68 by, e.g., screws 76. When the base 46 is pulled out of the printer body, the rear end of the revolver 100 is supported by the rear support plate 55 of the base 46. On the other hand, just before the base 46 is fully inserted into the printer body, the tapered center shaft 52 of the revolver 100 begins to enter the hole 54. As the center shaft 52 penetrates the hole 54, the rear end of the revolver 100 is sequentially raised. When the base 46 is fully inserted into the printer body, the rear end of the revolver 100 is fully raised away from the rear support plate 55. In this condition, the revolver 100 has its front end supported by the support rollers 49 of the base 46 accurately positioned relative to the printer body. At the same time, the rear end of the revolver 100 is positioned by the rear side wall 53 via the center shaft 52.

A revolver output gear 78 is mounted on the rear side wall 53 of the apparatus body and driven by a revolver motor 77 also mounted on the rear side wall 53. The revolver motor 77 is implemented by a stepping motor by way of example. A revolver input gear 79 is fastened to the rear of the rear end wall 51 of the developing unit 40 by, e.g., screws and has substantially the same diameter as the end wall 51. The revolver output gear 78 drives the revolver input gear 79.

Figure 4:
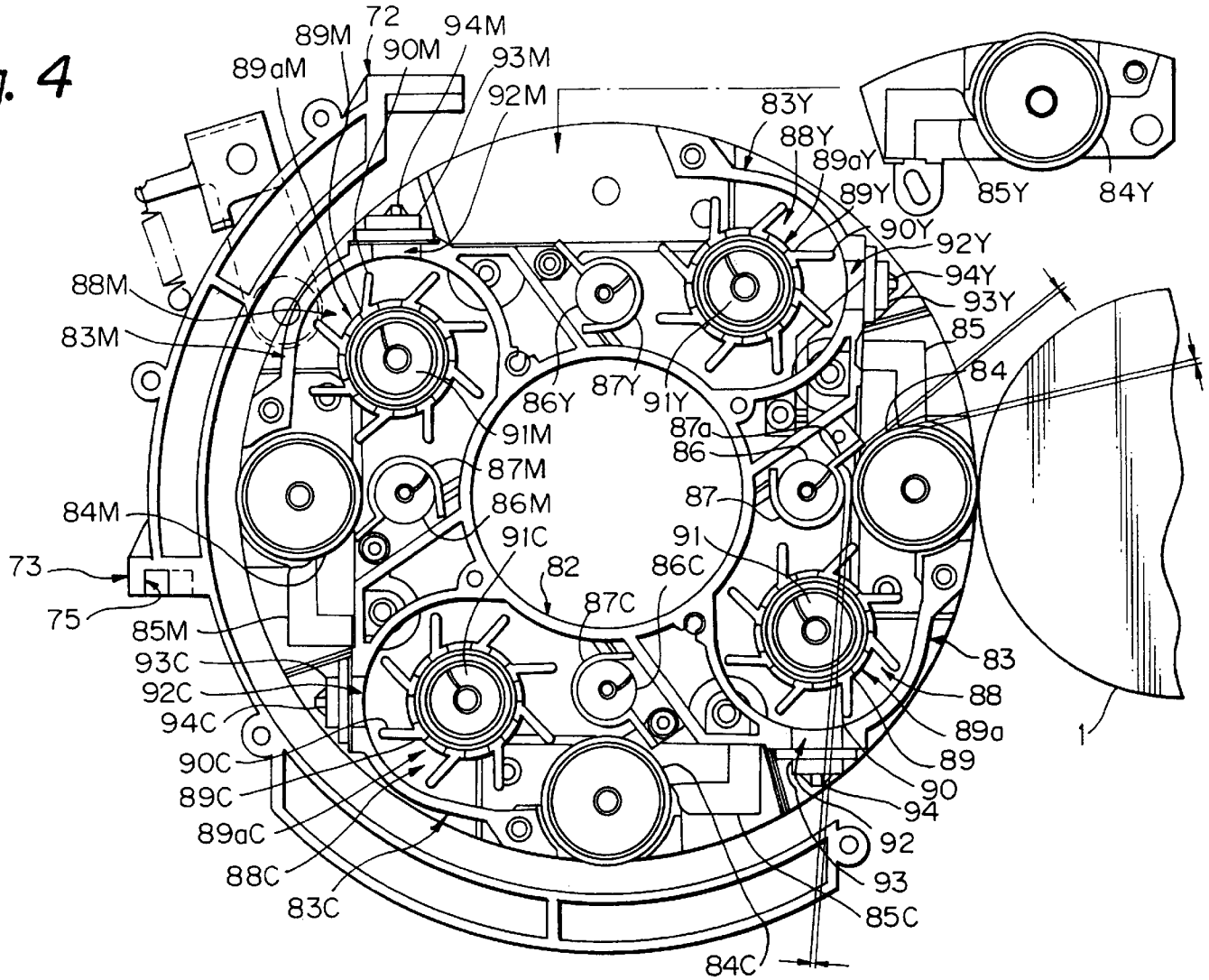
FIG. 4 is a section showing the internal arrangement of the developing unit.

FIG. 4 shows the internal structure of the developing unit 40 specifically. As shown, the developing unit 40 includes the disk-like front and rear end walls stated above and a partition extending between the end walls. The partition is made up of a hollow cylindrical portion 82 and casing portions 83, 83C, 83M and 83Y. The cylindrical portion 82 accommodates a cylindrical black toner bottle storing black toner. The casing portions 83–83Y extend radially outward from the cylindrical portion 82 and divide a space around the cylindrical portion 82 into four substantially identical developing chambers in the circumferential direction. The developing chambers each store a two-ingredient type developer of particular color, i.e., a toner and carrier mixture. In the specific condition shown in FIG. 4, the developing chamber facing the drum 1, i.e., located at a developing position is a black developing chamber storing a black developer. The developing chambers sequentially following the black developing chamber in the counterclockwise direction in FIG. 4 are a yellow developing chamber storing a yellow developer, a magenta developing chamber storing a magenta developer, and a cyan developing chamber storing a cyan developer.

The casing 83 forming the black developing chamber located at the developing position is formed with an opening facing the drum 1. A developing roller or developer carrier 84 is disposed in the black developing chamber and partly exposed to the outside via the above opening. A doctor blade 85, an upper screw conveyor 86, a guide 87 guiding the screw conveyor 86, and a paddle or agitator 88 are positioned in the black developing chamber. The doctor blade 85 regulates the amount of the developer being conveyed by the developing roller toward the developing position. The upper screw conveyor 86 conveys the developer removed by the doctor blade 85 from the rear to the front along the axis of the developing unit 40. The paddle 88 agitates the developer existing in the developing chamber. The paddle 88 is made up of a hollow cylindrical portion 89 and a plurality of blades 90 extending radially outward from the cylindrical portion 89. The cylindrical portion 89 is formed with a plurality of developer outlets 89*a* elongate in the widthwise direction of the developing roller 84. A lower screw conveyor 91 is disposed in the cylindrical portion 89 for conveying the developer in the axial direction in the opposite direction to the screw conveyor 86. A developer discharge opening 92 is formed in the casing portion below the lower screw conveyor 91 and extends in the axial direction. At the time of replacement of the deteriorated developer, the opening 92 is used to discharge the used developer and, if necessary, to introduce a fresh developer (containing toner). A cap 93 for covering the opening 92 is fastened to the casing portion by, e.g., screws 94.

The front ends of the screw conveyors 86 and 91 extend outward over the effective width range of the developing roller 84. A drop section, not shown, is arranged such that the developer conveyed to the front end by the upper screw conveyor 86 drops onto the front end of the lower screw conveyor 91 due to gravity. The front end of the lower screw conveyor 91 extends to the front over the above drop section as far as a communication chamber below a toner replenishing roller 97 which will be described later. In this configuration, the developer deposited on the developing roller 84, but removed by the doctor blade 85 and conveyed to the front by the guide 87 and upper screw conveyor 86 is caused to drop onto the lower screw conveyor 91 via the drop section, conveyed to the effective width of the roller 84 by the screw conveyor 91, delivered to the developing chamber via the outlet of the cylindrical portion of the paddle 88, and again deposited on the roller 84. That is, so-called horizontal agitation is effected in the developing chamber. The developer discharged from the cylindrical portion 82 of the paddle 88 to the bottom of the developing chamber is agitated by the blades 90 of the paddle 88, i.e., by so-called vertical agitation. Fresh toner caused to drop onto the lower screw conveyor 91 in the communication chamber by the replenishing roller 97 is screw conveyed to the drop section by the conveyor 91. As a result, the fresh toner is mixed with the developer dropped from the upper screw conveyor 86 and then introduced into the developing chamber, increasing the toner content of the developer existing in the developing chamber.

A developing roller gear is mounted on the developing roller 84 extending to the rear throughout the rear end wall 51 over the revolver input gear 79. An upper and a lower screw gear are mounted on the end portions of the screw conveyors 86 and 91, respectively. These gears are positioned in the vicinity of the rear end wall 51, i.e., at the rear of the revolver input gear 79.

Figure 5:
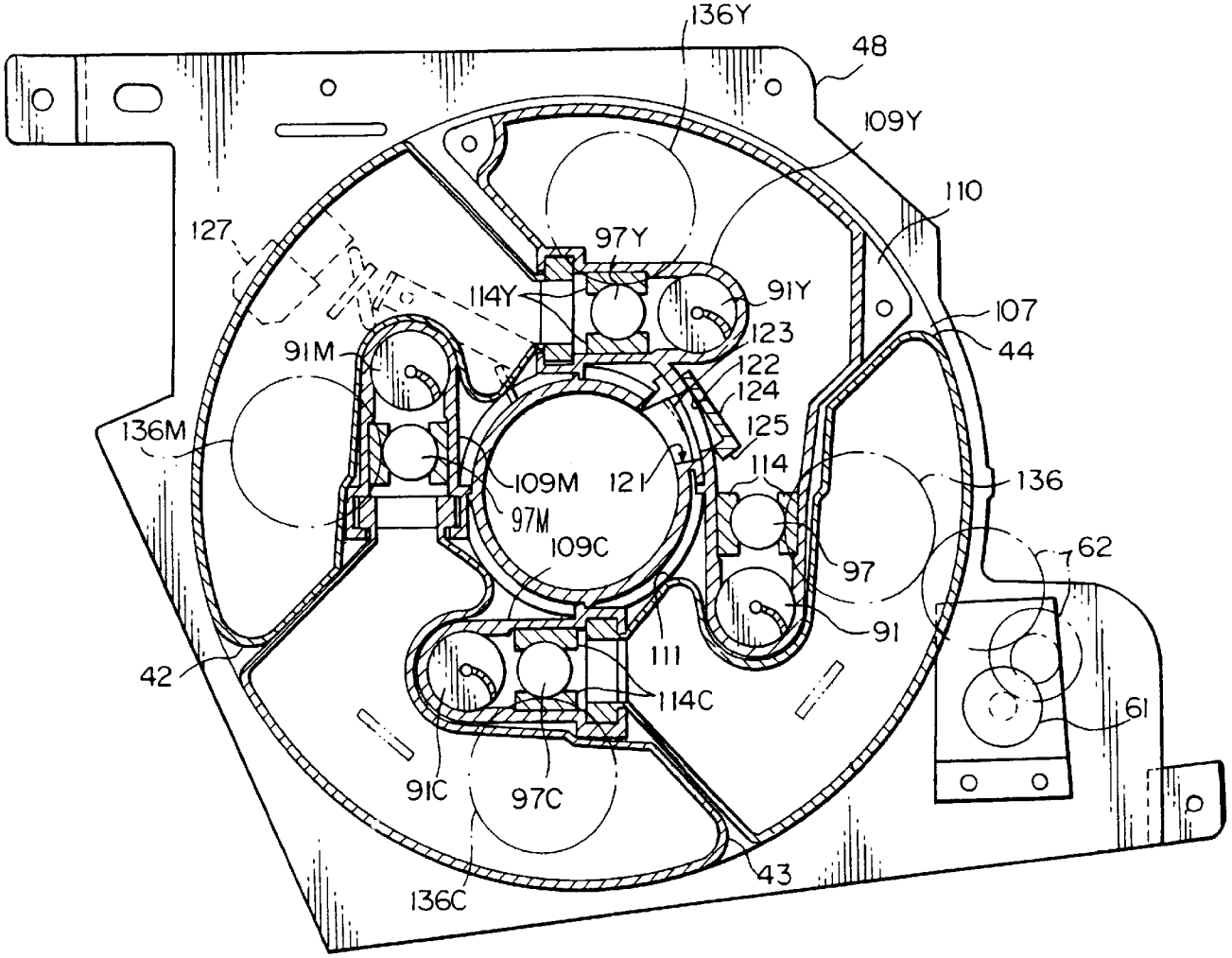
FIG. 5 is a section showing the internal arrangement of a toner storing unit also included in the developing device.

FIG. 5 is a section showing the internal arrangement of the toner storing unit 45 in a specific condition corresponding to the condition shown in FIG. 4. As shown, the toner storing unit 45 includes a disk-like end plate 108 (see FIG. 2 also), four toner cases 109Y, 109M, 109C and 110 mounted on the front end of the end plate 108 and corresponding one-to-one to the developing chambers, and toner replenishing rollers 97Y, 97M, 97C and 97 respectively disposed in the toner cases 109Y–110. The toner replenishing rollers 97Y–97 are each journalled to the front wall of the case and end plate 108 such that when the associated developing chamber is located at the developing position, the replenishing roller is positioned substantially just above the extension of the associated lower screw conveyor 91.

The end plate 108 is formed with a circular opening 111 for receiving a cylindrical black toner container at its center. The toner cases 109Y–110 are mounted on the end plate 108 around the opening 111. Further, the end plate 108 is formed with holes for receiving the lower screw conveyors and trough-like screw covers, as the case may be, extending from the developing chambers. The lower screw conveyors extend into the associated toner cases 109Y–110.

A position for replacing a color toner container from the toner storing unit 45 is strictly limited by the configuration of the cover 47. Specifically, as shown in FIG. 2, the cover 47 is formed with a notch 47*a* positioned at the downstream side in the direction of removal of a toner container. A toner container can be removed only through the notch 47*a*. The part of the notch 47*a* formed in the end face of the cover 47 includes a center portion assigned to a black toner container and a peripheral portion assigned to a single color toner container. In the illustrative embodiment, the peripheral portion aligns with a color toner container corresponding to the developing chamber brought to the developing position. The toner case corresponding to the color toner container which can be pulled out via the peripheral portion has a toner inlet facing upward. Therefore, even if toner is present around the toner inlet when the color toner container is pulled out, the toner is prevented from dropping. In the illustrative embodiment, the black toner container is replaced in the condition shown in FIG. 5, i.e., when the black toner case 110 aligns with the notch.

Figure 6:
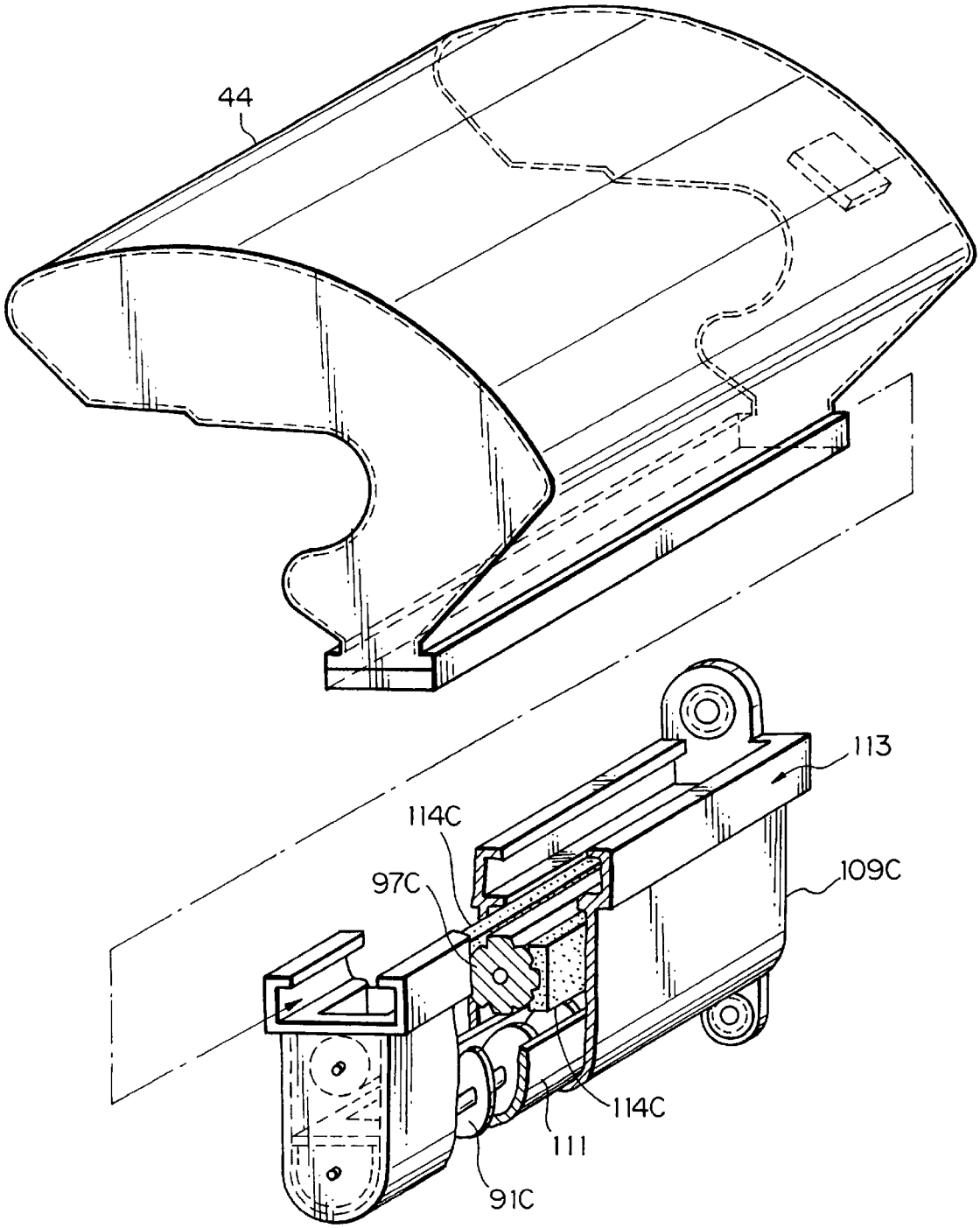
FIG. 6 is a perspective view showing a toner case and a toner container assigned to cyan by way of example.

FIG. 6 shows the cyan toner case 109C and cyan toner container 44 to be mounted to the case 109C. All the color toner cases 109Y–109C have an identical configuration. As shown, the cyan toner case 109C includes a wall surrounding the extension of the lower screw conveyor 91C extending into the case 109C and the toner replenishing roller 97C. A toner inlet is formed in the above wall and positioned above the replenishing roller 97C when the associated developing chamber is brought to the developing position. The cyan toner container 44 is mounted to amount portion 113 with its toner outlet facing downward and aligning with the above toner inlet. The color toner containers 42–44 are identical in configuration. A seal member 114C is interposed between the replenishing roller 97C and the inner periphery of the toner case 109C facing the roller 97C. The seal member 114C and roller 97C divide the mount portion 113 into a toner container side and a developing chamber side. Further, the seal member 114C and inner periphery surrounding the roller 97C and screw 91C define the previously mentioned communication chamber.

As shown in FIG. 6, the mount portion 113 allows the toner container 44 to be mounted and dismounted by being slid in the axial direction of the revolver 100. The mount portion 113 includes a member, not shown, for preventing the toner container 44 positioned on the mount portion 113 from being simply slid out of the mount portion 113. To remove the toner container 44, the operator closes the toner outlet of the container 44 by use of a shutter member, releases the above member, and then pulls the container 44 out of the mount portion 113. To set a new toner container 44 on the mount portion 113, the operator should preferably slide the new toner container 44 with a seal member toward the mount portion 113, position the container 44 on the mount portion 113, and then peel off the seal member in order to uncover a toner outlet.

Referring again to FIG. 5, the black toner case 110 corresponding to the black developing chamber has a contour substantially identical with the contour of, e.g., the color toner case 109Y and color toner container 44 is mounted thereon. A seal member 114 sealing the toner replenishing roller 97 from the inner periphery of the case 110 is disposed in the wall portion of the case 110. The extension of the lower screw conveyor 91 is disposed in a communication chamber communicated to the black developing chamber. A toner inlet 122 is formed in the wall similar in configuration with the color toner container at a position facing the center line of the revolver 100. The toner inlet 122 corresponds in configuration to the toner outlet 121 of the black toner container 41. Fresh black toner introduced from the toner container 41 via the toner inlet 122 gathers in a region surrounded by the wall portion and replenishing roller 97 and corresponding to the hopper of a conventional toner replenishing device. The replenishing roller 97 is rotated to deliver the black toner from the above region to the communication chamber. The toner inlet 122 can be closed from the inside by a shutter 124 hinged at one end to a shaft 123 parallel to the axis of the revolver 100. The shutter 124 rotates about the shaft 123 due to its own weight in accordance with the rotation of the revolver 100, automatically opening or closing the toner inlet 122. A seal member 125 is fitted on the edge of the shutter 124 for surely sealing the toner inlet 122.

As shown in FIG. 6, the toner replenishing roller 97C (97Y, 97M or 97) includes a roller portion formed with a plurality of axial grooves in its circumference. A gear is mounted on the end of a shaft extending throughout the bearing of the end plate 108 to the developing unit 40. A replenishment input gear 136C is held in mesh with the gear. As shown in FIG. 5, a replenishment input gear 136 associated with the toner replenishing roller 97 of the developing chamber located at the developing position is brought into mesh with the gear 62. The gear 62 is driven by the motor 61 mounted on the front support plate 48, as stated earlier.

The printer further includes toner near-end sensing means responsive to the toner near-end or toner end (toner near-end hereinafter) conditions of the toner cases 109Y–110 included in the developing unit 40. In addition, the printer includes home position sensing means responsive to the home position of the revolver 100. In the illustrative embodiment, the home position of the revolver 100 refers to a position where the cyan developing chamber is positioned downstream of the developing position in the direction of rotation of the revolver 100, and the black developing chamber is positioned upstream of the same.

The toner near-end sensing means emits light into any one of the toner containers 41–44 via a transparent portion formed in the side of the toner container. Only when the amount of toner remaining in the toner container is less than a preselected amount, the light is transmitted through the inside of the toner container and incident to a light-sensitive section. A toner near-end sensor determines whether or not the light is incident to the light-sensitive section.

The home position sensing means is implemented by a photointerrupter, not shown, a shield member, not shown, and a home position sensor, not shown. The photointerrupter is generally U-shaped and mounted on the printer body. The shield member is mounted on the outer periphery of the revolver 100 for shielding light. The home position sensor determines whether or not the shield member has shielded light issuing from the photointerrupter. Only when the revolver 100 is located at its home position, the shield member enters the recess of the photointerrupter and shields the light.

Hereinafter will be described the positioning of the revolver 100 using the motor 70. In the illustrative embodiment, the revolver output gear 78 driven by the motor 77 is control led such that the revolver 100 rotates by each preselected angle. This eliminates the need for a positioning roller or similar mechanical positioning member.

Figure 7:
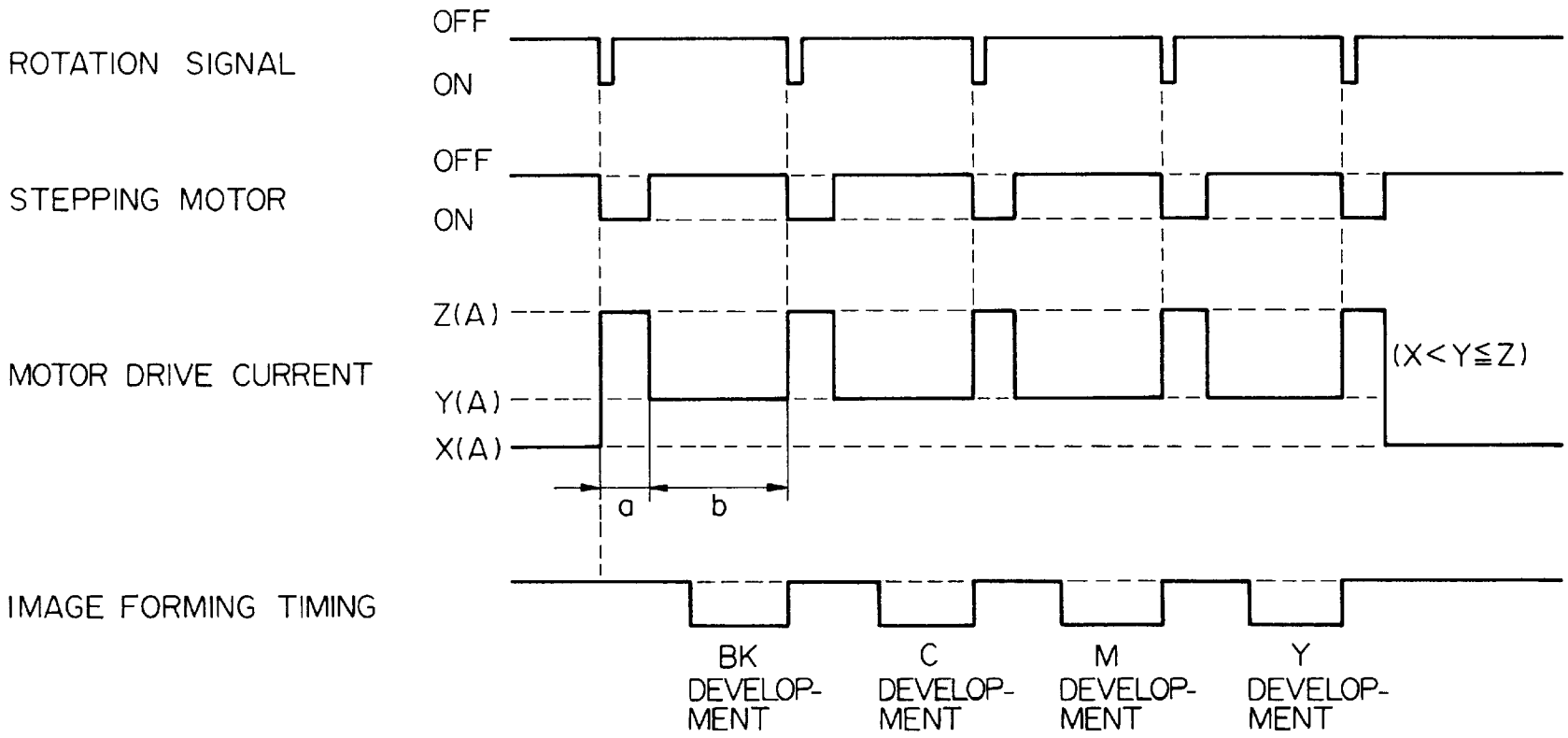
FIG. 7 is a timing chart demonstrating a specific operation for producing a full-color copy by usual development.

FIG. 7 is a timing chart showing a specific image forming timing for producing a single full-color copy by usual development, a specific ON/OFF timing of a signal for causing the revolver 100 to rotate, a specific stepping motor drive current, and a specific stepping motor ON/OFF timing. As shown, before image formation, the rotation signal is held in its OFF state while a current of X amperes (zero ampere in the embodiment) flows through the stepping motor.

When the rotation signal goes ON, a current necessary for the rotation of the revolver 100 (Z amperes) flows through the stepping motor. The drive phase of the stepping motor is sequentially switched such that the black developing chamber of the revolver 100 is brought to the developing position where the black developing chamber faces the drum 1 (a, FIG. 7). On the arrival of the black developing chamber at the developing position, a current (Y amperes) flows through the stepping motor in order to prevent the revolver 100 from rotating even when subjected to an unexpected extraneous force. In this waiting state (b, FIG. 7), a latent image representative of a black image and formed on the drum 1 is developed.

After a black toner image has been formed, the rotation signal again goes ON in order to repeat the above control. As a result, a cyan image or image of the second color is formed. Thereafter, a magenta image and a yellow image are sequentially formed as images of the third color and fourth color, respectively. Then, the rotation signal gain goes ON to return the revolver 100 to its home position. As soon as the rotation signal goes OFF, the current of X amperes flows through the stepping motor, so that the revolver 100 can be rotated by an extraneous force.

The currents X, Y and Z to flow through the stepping motor are held in a relation of $X<Y\leqq Z$.

When the toner near-end condition of any one of the toner containers 41, 42 and 43 is sensed, toner must be replenished into the developing chamber associated with the empty toner container. For toner replenishment, the empty toner container must be replaced with a new toner container. The illustrative embodiment includes a mechanism for preventing, during the replacement of the toner container, the revolver 100 from rotating due to an unexpected change in the voltage or the current driving the stepping motor. This mechanism will be described with reference to FIGS. 8, 9A and 9B.

Figure 8:
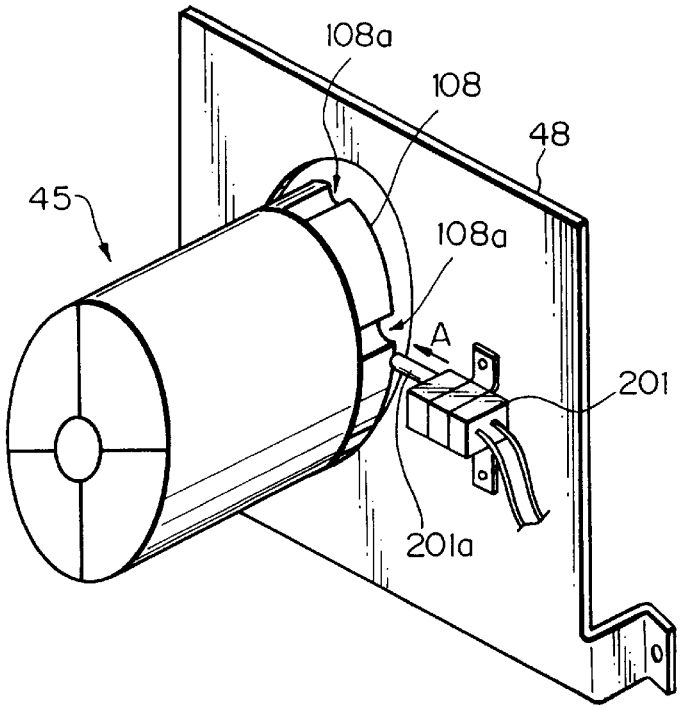
FIG. 8 is a perspective view showing a specific configuration of a rotation preventing mechanism included in the first embodiment.
Figure 9A:
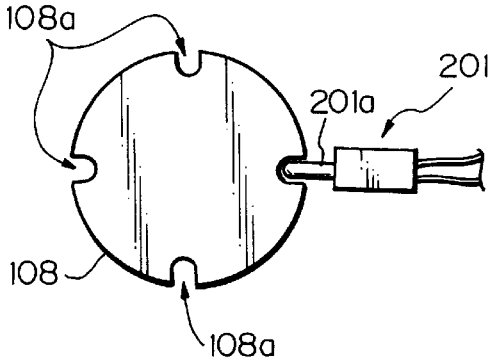
FIGS. 9A and 9B each shows the mechanism of FIG. 8 in a particular condition.

As shown in FIG. 8, the mechanism is implemented by four notches 108*a* formed in the disk-like end plate 108 of the revolver 100, and a solenoid 201 mounted on the front support plate 48 affixed to the front side wall 68. A plunger 201*a* protrudes from the solenoid 201 and plays the role of a locking member. When the solenoid 201 is turned on or turned off, the plunger 201*a* engages with the notch 108*a* facing it and prevents the revolver 100 from rotating, as shown in FIG. 9A, or retracts from the notch 108*a*.

The four notches 108*a* are equally spaced in the circumferential direction of the end plate 108. This allows the revolver 100 to stop rotating at four different angular positions where the toner containers 41–44 can be replaced.

Figure 9B:
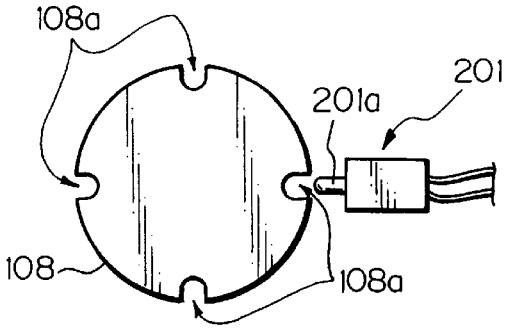

A controller, not shown, including a CPU (Central Processing Unit) turns on the solenoid 201 at a timing which will be described and thereby moves the plunger 201*a* in a direction indicated by an arrow A in FIG. 8. As a result, the plunger 201*a* engages with the notch 108*a* facing it so as to prevent the revolver 100 from rotating, as shown in FIG. 9A. When the controller turns off the solenoid 201, the plunger 201*a* is retracted into the solenoid 201 away from the notch 108*a,* as shown in FIG. 9B. This allows the revolver 100 to rotate.

To replace any one of the toner containers 41–44, the operator is required to open the front door of the printer body. It follows that even when the toner near-end condition is sensed, it is not necessary to forcibly inhibit the rotation of the revolver 100 before the front door is opened. That is, the rotation of the revolver 100 may be inhibited only when the front door is opened. The illustrative embodiment includes front door sensing means for determining whether or not the front door is opened. The controller selectively turns on or turns off the solenoid 201 on the basis of the output signal of the front door sensing means. The front door sensing means may be implemented by a lug to be pushed into the printer body when the front door is closed, and a sensor responsive to the position of the lug.

Figure 10:
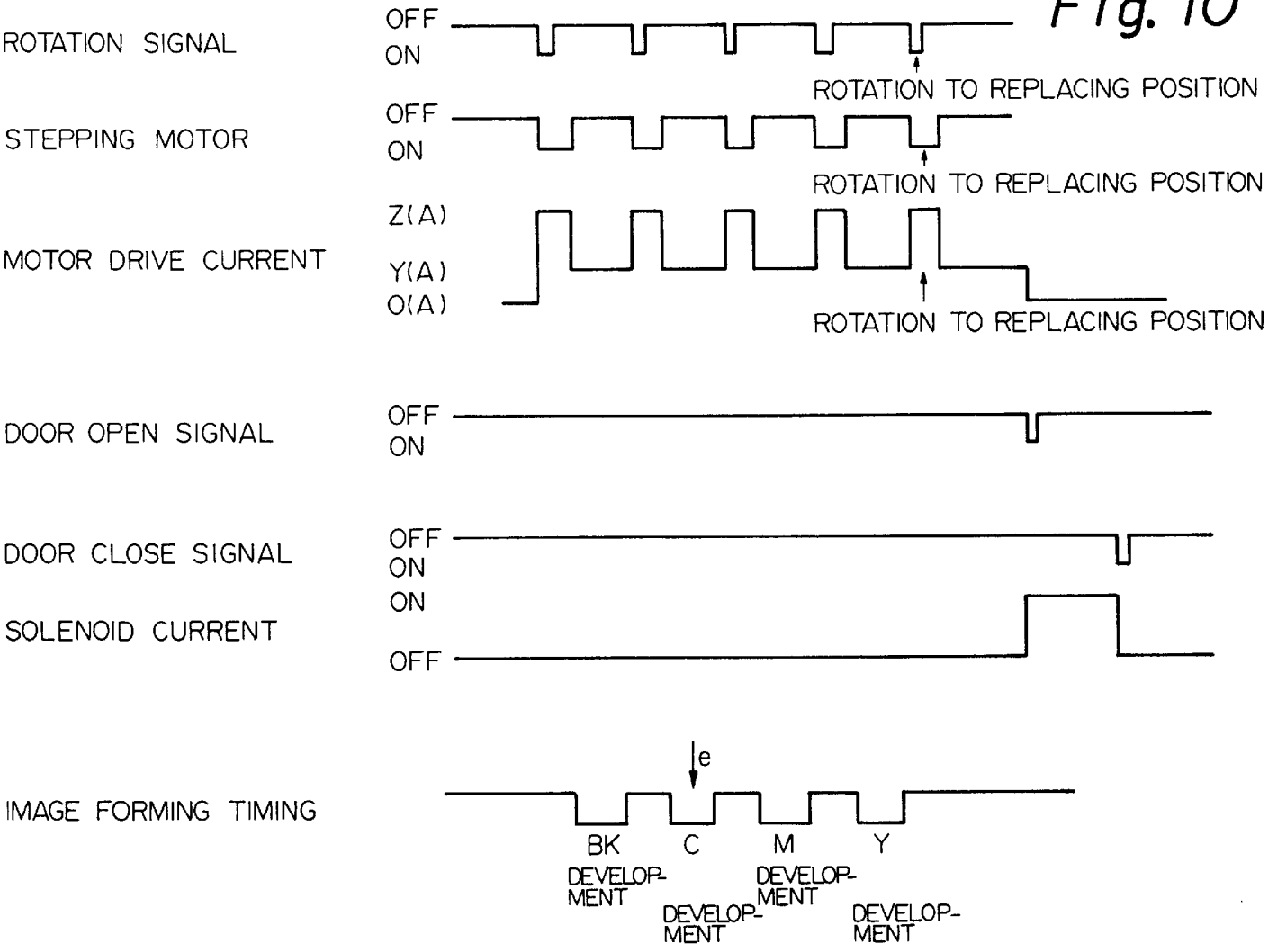
FIG. 10 is a timing chart showing a specific operation to occur when a toner near-end condition is sensed in the illustrative embodiment.

FIG. 10 shows a specific image forming timing, a specific ON/OFF timing of the rotation signal for rotating the revolver 100, a specific drive current for the stepping motor, a specific rotation timing of the stepping motor, a specific front door open signal, a specific front door close signal, and a specific solenoid drive current. The various sections are control led in the same manner as during usual image formation shown in FIG. 7 until a toner end condition has been sensed. Assume that during the formation of a C image a toner near-end condition is sensed at a time e. Then, the usual control is continuously effected until the remaining images have been formed. When a yellow image or last image is fully formed, the revolver 100 is rotated to its position allowing the cyan toner container 44 to be replaced. Thereafter, the current (Y amperes) simply applying a stop torque to the revolver 100 flows through the stepping motor, so that the revolver 100 is locked in position.

When the operator intending to replace the toner container 44 opens the front door of the printer body, the front door open signal goes ON. Then, the current for driving the stepping motor is immediately reduced to zero ampere while the solenoid 201 is turned on. As a result, the plunger 201*a* of the solenoid 201 engages with the notch 108*a* and stops the rotation of the revolver 100.

As soon as the operator completes replacement and closes the front door, the front door close signal goes ON. In response, the solenoid 201 is turned off and renders the revolver 100 rotatable.

As stated above, the above mechanism is capable of preventing the revolver 100 from rotating without continuously feeding a current for maintaining the stepping motor stationary. Therefore, even when an unexpected change occurs in the current driving the stepping motor, the revolver 100 remains stationary. It follows that the revolver 100 is prevented from suddenly rotating during replacement of the toner container due to an unexpected change in the voltage or the current driving the stepping motor. This obviates an occurrence that the toner or the toner container drops or that a new toner container cannot be set in a preselected position.

Figure 11:
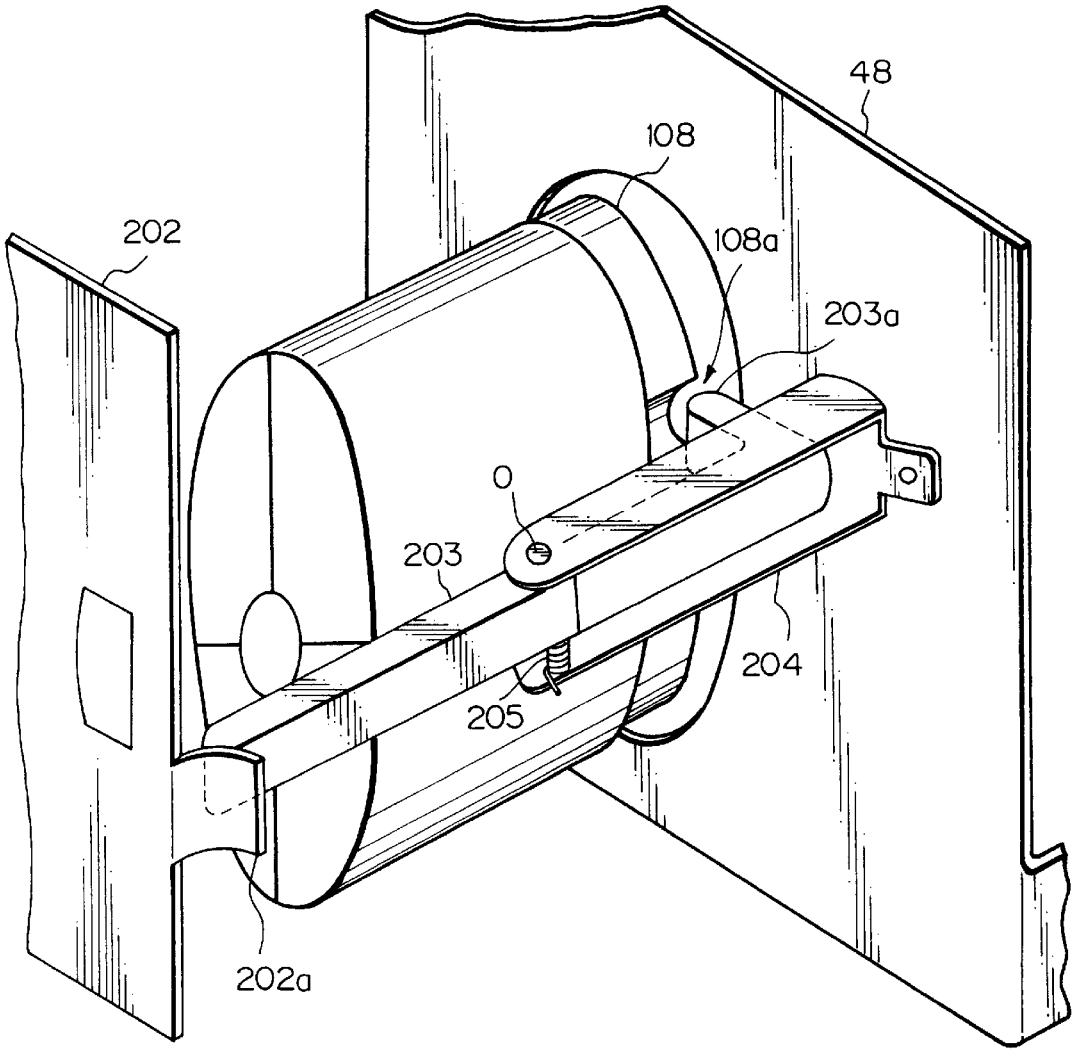
FIG. 11 is a perspective view showing another specific configuration of the rotation preventing mechanism.

FIG. 11 shows another specific configuration of the mechanism for preventing the rotation of the revolver 100. The mechanism of FIG. 11 differs from the mechanism of FIG. 8 in that it includes a locking portion 203*a* engageable with any one of the notches 108*a,* and a moving device for causing the locking portion 203*a* to engage with any one of the notches 108*a* in interlocked relation to the opening of the front door. The moving device transforms the movement of the front door to the movement of the locking portion 203*a*. Specifically, as shown in FIG. 11, a pressing member 203 includes the above locking portion 203*a* and is angularly movable in the horizontal direction. A bracket 204 is affixed to the front support plate 48 and has a fulcrum 0 supporting the pressing member 203. A coiled torsion spring or biasing member 205 constantly biases the pressing member 203 such that the locking portion 203*a* tends to engage with the notch 108*a*. An abutment 202*a* forms a part of a front door 202 and causes the pressing member 203 to rotate when the front door is opened or closed.

Figure 12A:
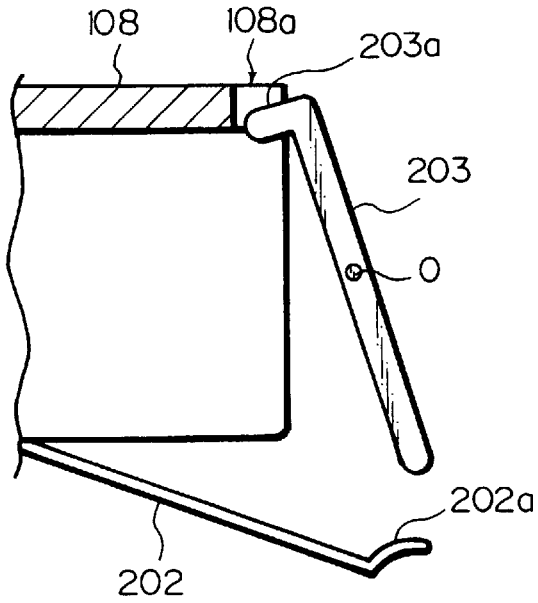
FIGS. 12A and 12B are plan views showing a moving device included in the mechanism of FIG. 11.
Figure 12B:
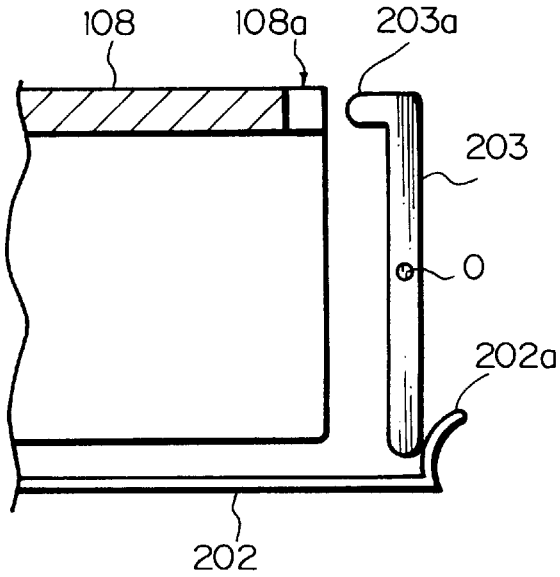

FIGS. 12A and 12B are plan views demonstrating the operation of the mechanism shown in FIG. 11 specifically. When the front door 202 is open, the torsion spring 205 maintains the pressing member 203 in the position shown in FIG. 12A. In this position, the locking portion 203*a* enters the notch 108*a* and prevents the revolver 100 from rotating. When the front door 202 is closed, the abutment 202*a* moves the pressing member 203 to the position shown in FIG. 12B. As a result, the locking portion 203*a* is retracted from the notch 108*a* and allows the revolver 100 to rotate.

In the printer including the mechanism of FIG. 11, when a toner near-end condition is sensed during image formation, the revolver 100 is rotated, after the formation of all of the images, to a position where the toner container 44 in the toner near-end condition can be replaced. Thereafter, the current (Y amperes) simply applying a stop torque to the revolver 100 is caused to flow through the stepping motor, maintaining the revolver 100 unmovable.

When the operator opens the front door in order to replace the toner container 44, the front door open signal goes ON. Then, the current for driving the stepping motor is immediately reduced to zero ampere. At the same time, the moving device brings the locking portion 203*a* of the pressing member 203 into engagement with the notch 108*a* and thereby prevents the revolver 100 from rotating.

As soon as the operator completes the replacement and closes the front door, the moving device moves the locking portion 203*a* away from the notch 108*a* and renders the revolver 100 rotatable.

As stated above, the mechanism shown in FIG. 11 mechanically interlocks the movement of the front door to the movement of the locking portion 203*a*. This mechanism does not need a solenoid and therefore saves power and cost, compared to the mechanism of FIG. 8.

In the above embodiment, the current simply applying the stop torque to the stepping motor is caused to flow from the time when the revolver 100 reaches a position for replacing a desired toner container to the time when the front door is opened. Alternatively, the drive current may be immediately reduced to zero ampere when the revolver 100 reaches the above position.

Second Embodiment

Figure 13:
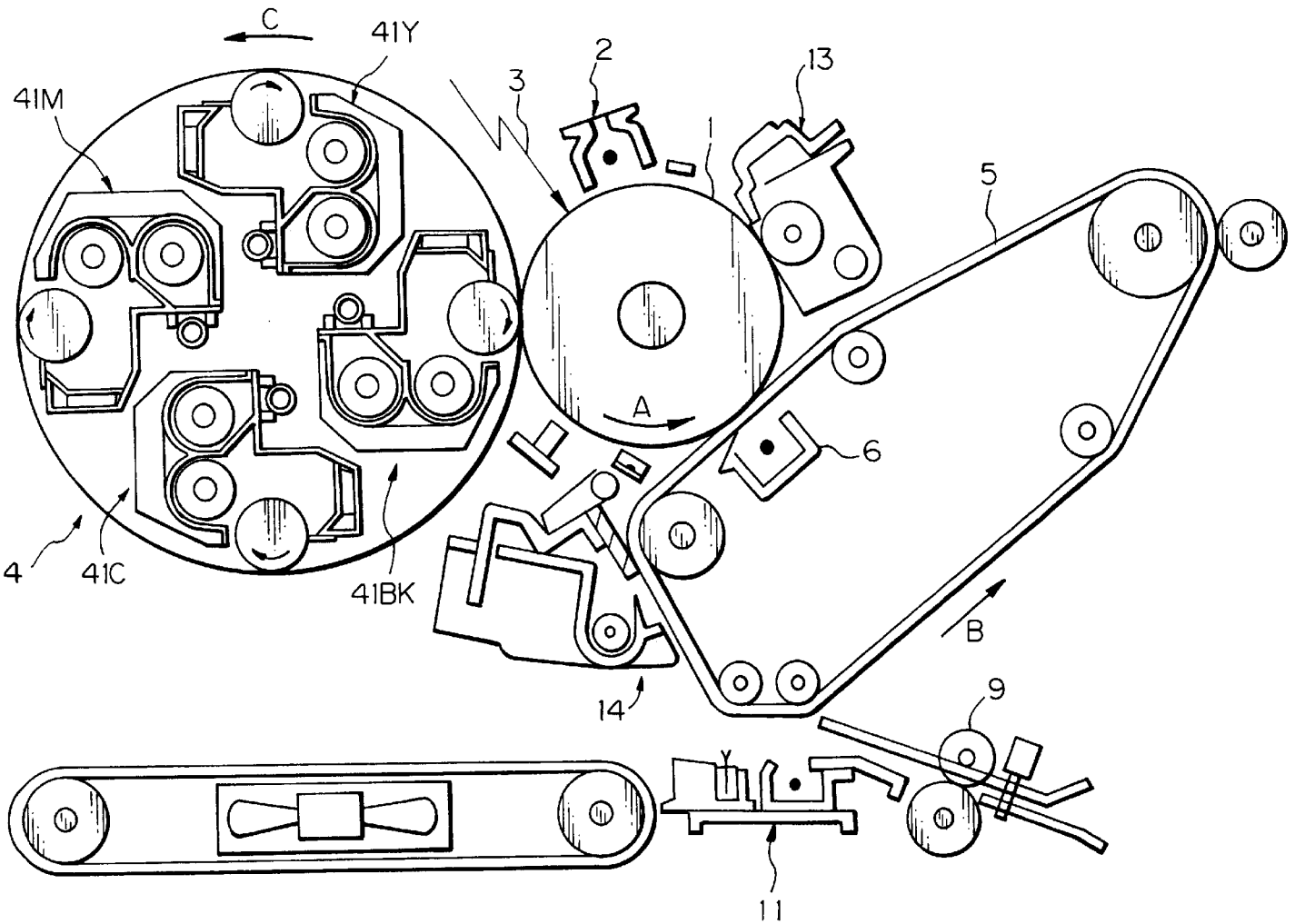
FIG. 13 shows a second embodiment of the image forming apparatus in accordance with the present invention.

Reference will be made to FIG. 13 for describing an alternative embodiment of the present invention. As shown, while the drum or image carrier 1 is rotated in a direction indicated by an arrow A, the main charger or main charging means 2 uniformly charges the surface of the drum 1. The laser optics 3 scans the charged surface of the drum 1 in accordance with image data, thereby electrostatically forming a latent image on the drum 1. The image data is single color image data produced by separating a desired full-color image into yellow, magenta, cyan and black color data. The revolver type developing device 4 develops the latent image with a preselected one of yellow toner, magenta toner, cyan toner and black toner to thereby form a corresponding toner image. In this manner images of different colors are sequentially formed on the drum 1.

The developing device 4 is made up of a developing unit and a toner storing unit. In the illustrative embodiment, the developing unit has four developing chambers (developing subunits hereinafter) rotatable about the axis of the device and brings any one of the developing subunits to a developing position where the subunit faces the drum 1. The toner storing unit has four toner containers respectively corresponding to the developing subunits and is rotatable integrally with the developing unit. Specifically, the developing unit has, e.g., a black developing subunit 41Bk, a cyan developing subunit 41C, a magenta developing subunit 41M, and a yellow developing subunit 41Y. The developing unit has a substantially cylindrical configuration and is rotatable about its axis in the printer body. The toner storing unit includes four toner cartridges respectively storing black toner, cyan toner, magenta toner and yellow toner and corresponding one-to-one to the developing subunits 41Bk–41Y. The toner storing unit is positioned at the front of the developing unit in the axial direction and substantially coaxial with the developing unit. The toner storing unit is rotatable integrally with the developing device 4. A revolver motor, which will be described later, rotates the developing device 4 in a direction indicated by an arrow C such that one of the developing subunits 41Bk–41Y is located at the developing position at a time.

A yellow, a magenta, a cyan and a black toner image sequentially formed on the drum 1 are sequentially transferred to the intermediate transfer belt 5 one above the other by the primary transfer charger 6. As a result, a composite or full-color image is formed on the belt 5. A secondary transfer charger 11 transfers the full-color image from the belt 5 to a paper fed from a duplex copy/auto paper feed cassette, not shown, or a manual tray, not shown, via the registration roller 9. After the full-color image has been fixed on the paper by a fixing unit, not shown, the paper or full-color printing is driven out of the printer.

The toner left on the drum 1 after the image transfer to the belt 5 is removed by the drum cleaner 13. Likewise, the toner left on the belt 5 after the image transfer to the paper is removed by the belt cleaner 14.

Figure 14A:
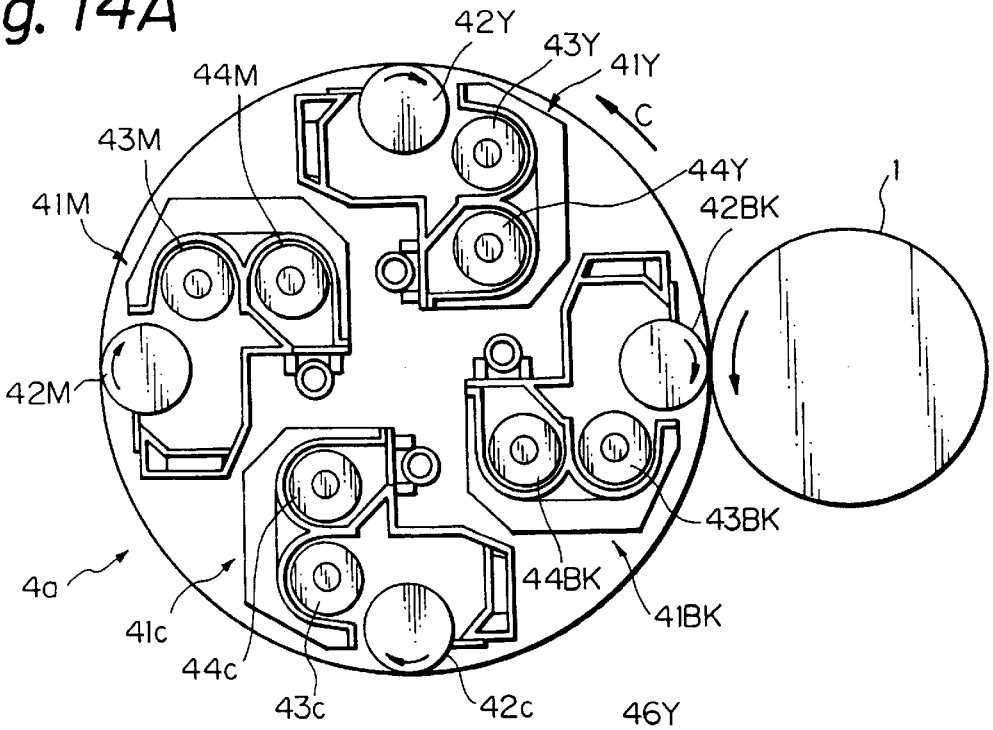
FIG. 14A is a section showing the internal arrangement of a developing unit included in the second embodiment.
Figure 14B:
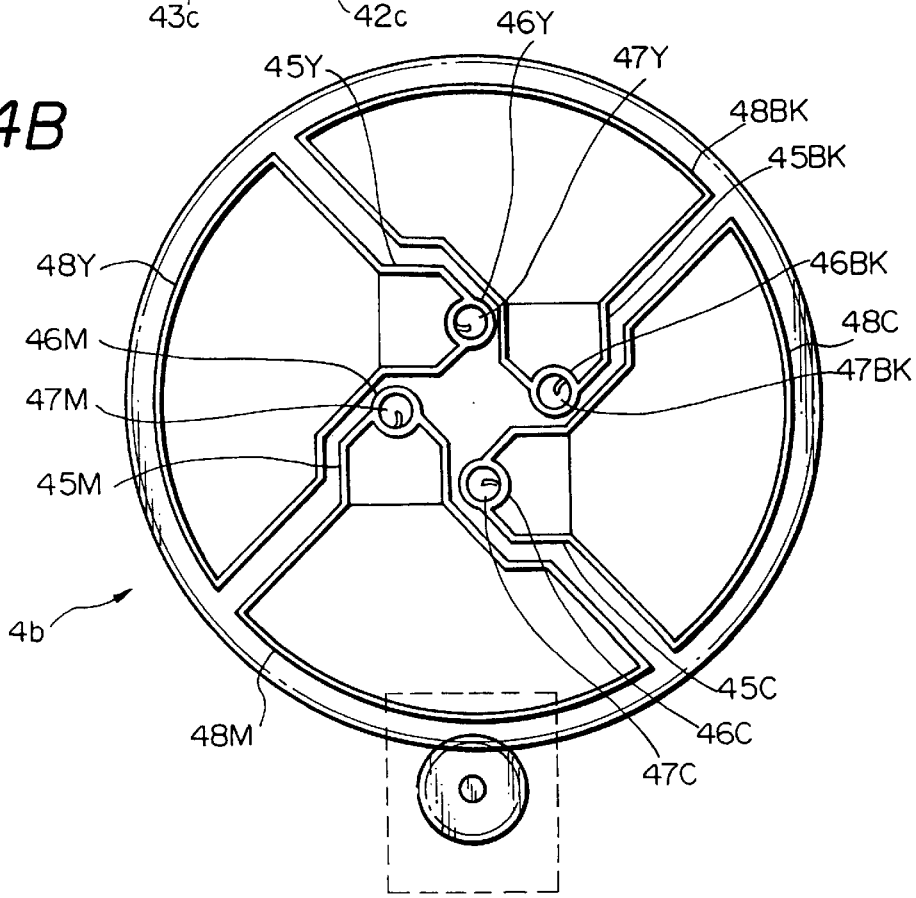
FIG. 14B is a section showing the internal arrangement of a toner storing unit also included in the second embodiment.

FIGS. 14A and 14B respectively show the internal arrangement of a developing unit 4*a* and the internal arrangement of a toner storing unit 4*b* which are included in the developing device 4. As shown in FIG. 14A, the developing unit 4*a* has four substantially identical developing subunits 41Bk, 41C, 41M and 41Y sequentially arranged in the circumferential direction. The developing subunits 41Bk–41Y each store a two-ingredient type developer of particular color. In the specific condition shown in FIG. 14A, the black developing subunit 41Bk is positioned to face the drum 1 at the developing position. The yellow developing subunit 41Y, magenta developing subunit 41M and cyan developing subunit 41C sequentially follow the black subunit 41Bk in the counterclockwise direction.

Because the developing subunits 41Bk–41C are identical in configuration with each other, the following description will concentrate on the black subunit 41Bk located at the developing position. The subunit 41Bk includes a developing roller or developer carrier 42Bk and a first and a second screw conveyor 43Bk and 44Bk extending parallel to the developing roller 42Bk. The screw conveyors 43Bk and 44Bk convey the developer in opposite directions to each other while agitating the developer. The first screw conveyor 43Bk is positioned closer to the developing roller 42Bk than the second screw conveyor 44Bk. The developing roller 42Bk is made up of a stationary magnet roller and a rotatable sleeve surrounding the magnet roller, although not shown specifically.

The developing unit 4*a* is rotated by each 90° in a direction indicated by an arrow C so as to sequentially bring the developing subunits 41Bk–41C to the developing position.

The toner storing unit 4*b* has four toner replenishing sections for respectively replenishing fresh toner to the four developing subunits 41Bk–41C. Specifically, as shown in FIG. 14B, the toner storing unit 4*b* has four toner hoppers 45Bk, 45Y, 45M and 45C corresponding one-to-one to the subunits 41Bk–41C. The toner hoppers 45Bk–45C each receive fresh toner from the associated toner cartridge. Pipes 46Bk, 46Y, 46M and 460 respectively extend from the toner hoppers 45Bk–45C in order to replenish toner to the associated subunits 41Bk–41C. Screw conveyors 47Bk, 47Y, 47M and 47C are respectively disposed in the pipes 46Bk–46C and extend into the associated toner hoppers 45Bk–45C. The screw conveyors 47Bk–47C each is positioned such that when the developing chamber corresponding to the screw conveyor is brought to the developing position, the screw conveyor lies substantially right above the extension of the second screw conveyor 44Bk.

The toner hoppers 45Bk–45C are identical in configuration with each other. Specifically, each toner hopper 45 includes a wall surrounding the screw conveyor 47 and formed with a toner inlet. When the developing subunit corresponding to the above toner hopper 45 is located at the developing position, the toner inlet is positioned above the screw conveyor 47. A mount portion is formed around the toner inlet and allows a corresponding one of the toner cartridges 48Bk, 48Y, 48M and 48C to be mounted thereto. At this instant, the toner outlet of the toner cartridge 48 faces downward and aligns with the toner outlet of the toner hopper 45.

The shaft of each screw conveyor 47 protrudes to the developing unit side, although not shown specifically. A gear, not shown, is mounted on the protruding end of the shaft. A replenishment input gear, not shown, is held in mesh with the above gear. Among the replenishment input gears, the gear of the screw conveyor 47 corresponding to the developing subunit located at the developing position is brought into mesh with a gear which is driven by a motor mounted on the rear side wall of the apparatus body.

Figure 15:
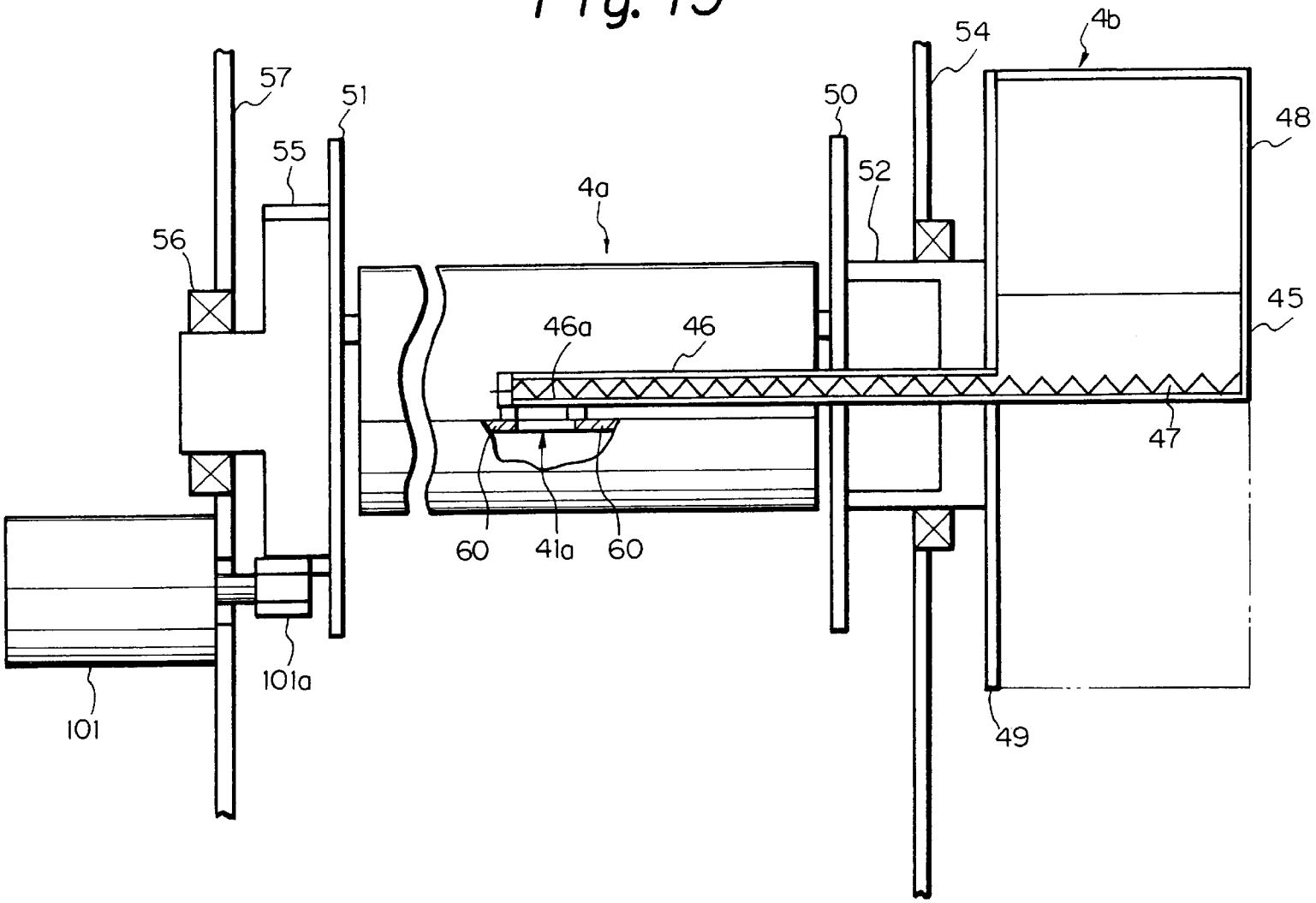
FIG. 15 is a vertical section showing a revolver type developing device included in the second embodiment.

FIG. 15 is a vertical section showing the developing device 4 together with members surrounding it. It is to be noted that the left side and right side of FIG. 15 are the rear side and front side, respectively. As for the toner storing unit 4*b*, only the toner cartridge 48 and toner hopper 45 assigned to one color are shown in FIG. 15 for simplicity. As shown, the developing unit 4*a* is supported by a revolver front plate 50 and a revolver rear plate 51. A center shaft 52 protrudes from the front plate 50 coaxially with the developing unit 4*a*. The center shaft 52 is positioned on and rotatably supported by a front wall 54 included in the printer body via a bearing. A revolver gear 55 is affixed to the rear end of the revolver rear plate 51. The center portion of the revolver gear 55 protrudes to the rear in the form of a shaft and is positioned on a rear wall 57 also included in the apparatus body via a bearing 56. In this configuration, the developing unit 4*a* is rotatably supported by the apparatus body.

The toner storing unit 4*b* is positioned in front of the developing unit 4*a*. The toner cartridges 48 and toner hoppers 45 assigned to a particular color each are integrally supported by a mount plate 49. The mount plate 49 is affixed to the center shaft 52. As a result, the toner storing unit 4*b* and developing unit 4*a* are constructed integrally with each other.

The pipe 46 extends from the toner hopper 45 into the developing subunit. The screw conveyor 47 disposed in the pipe 46 delivers fresh toner from the toner cartridge 48 and toner hopper 45 to the developing subunit. A toner outlet 46*a* is formed in one end of the pipe 46 positioned in the developing subunit for discharging the toner conveyed via the pipe 46. An opening 41*a* is formed in the portion of the developing chamber corresponding to the toner outlet 46*a* in order to receive the toner from the pipe 46. In this configuration, the pipe 46 and developing subunit 41 are communicated to each other. The toner conveyed by the screw 47 from the toner hopper 45 via the aligned openings 46*a* and 41*a* is replenished into the subunit 41. Seals 60 are arranged around the portion where the pipe 46 and subunit 41 are communicated to each other, thereby preventing the toner from flying about. The seals 60 may be implemented by foam polyurethane by way of example.

In the illustrative embodiment, first drive means rotates the developing unit 4*a* and toner storing unit 4*b* in order to locate a desired developing subunit at the developing position. Also, second drive means rotates the developing roller or image forming member included in the developing subunit brought to the developing position. The first and second drive means will be described specifically hereinafter.

The first drive means (revolver drive means hereinafter) includes a drive source for driving the developing unit 4*a* and toner storing unit 4*b,* and a drive transmission mechanism for transmitting the output torque of the drive source to the developing unit 4*a*. Specifically, the revolver drive means includes a revolver motor 101 and a drive transmission mechanism implemented by a revolver drive gear 101*a* and a revolver gear 55. The revolver motor 101 should preferably be implemented by a stepping motor capable of implementing an accurate stop position. The revolver motor 101 is mounted on the rear wall 57 of the printer body. The revolver drive gear 101*a* to be driven by the revolver motor 101 is also mounted on the rear wall and held in mesh with the revolver gear 55. The output torque of the revolver motor 101 is transmitted to the revolver gear 55 meshing with the revolver drive gear 101*a* via the revolver drive gear 101*a*. In this condition, the developing unit 4*a* affixed to the revolver gear 55 and the toner storing unit 4*b* affixed to the developing unit 4*a* are caused to rotate.

Figure 16:
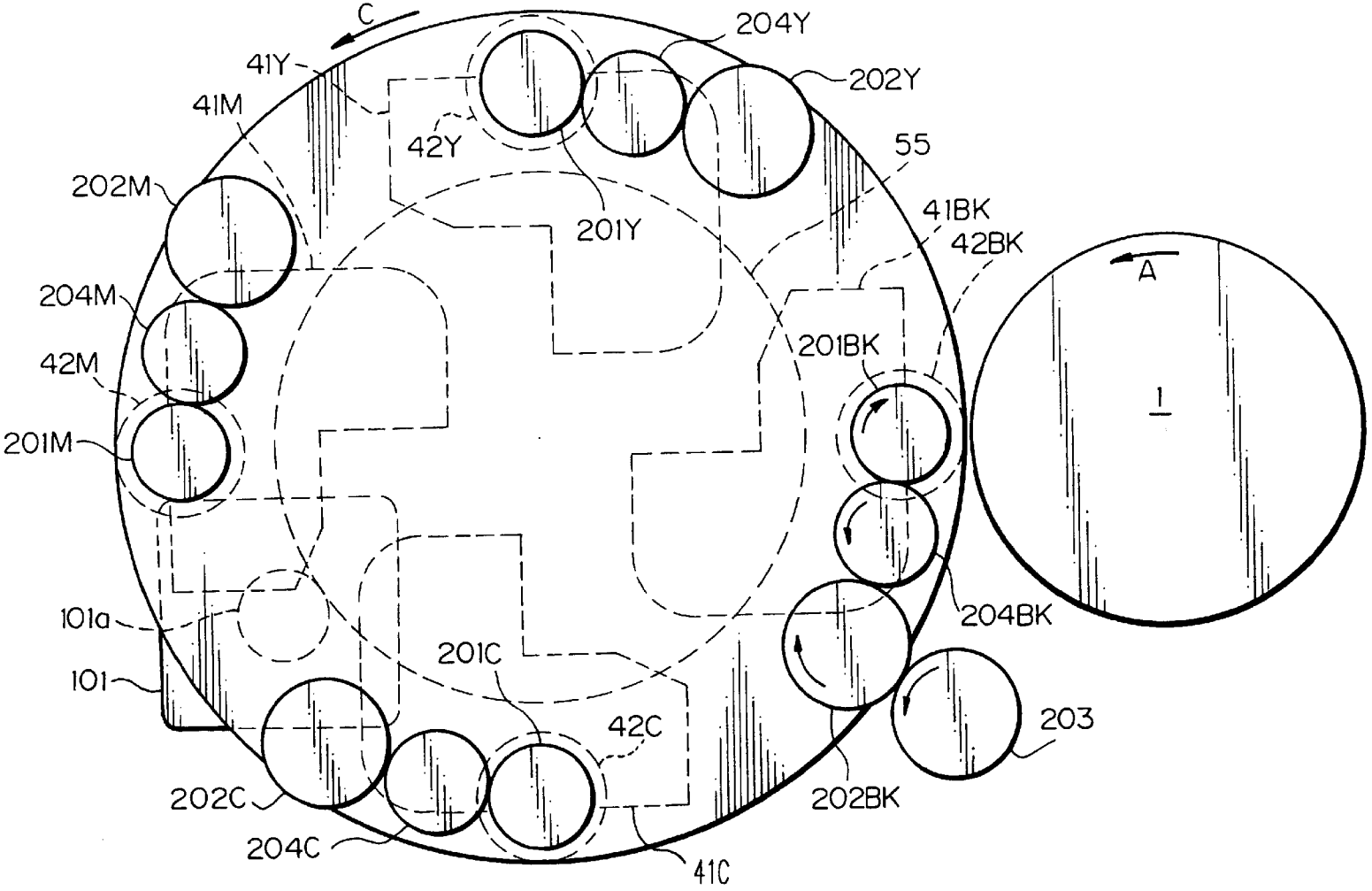
FIG. 16 shows a drive arrangement for driving the developing unit.

The second drive means (developing roller drive means hereinafter) includes a drive motor or drive source, not shown, for driving the developing roller, and a drive transmission mechanism for transferring the output torque of the drive motor to the developing roller. The drive transmission mechanism includes drive input gears respectively assigned to the four developing subunits, and a drive gear capable of meshing with the drive input gear of the subunit brought to the developing position. The output torque of the motor is transmitted from the drive gear to the drive input gear in the direction opposite to the direction of rotation of the developing unit 4*a*. Specifically, as shown in FIG. 16, there are arranged drive input gears 202Bk, 202Y, 202M and 202C mounted on the developing device 4 and respectively assigned to the four developing subunits, idle gears 204Bk, 204Y, 204M and 204C, and developing roller gears 201Bk, 201Y, 201M and 201C. Also, a drive gear 203 to be driven by the drive motor is mounted on the copier body. Such gears each rotates in a particular direction indicated by an arrow.

The drive input gears 202Bk, 202Y, 202M and 202C are rotatably mounted on the rear of the revolver rear plate, i.e., the rear plate of the developing unit 4*a*. The gears 202Bk–202C are each selectively brought into mesh with the drive gear 203, so that the output torque of the drive motor is transmitted to, e.g., the developing subunit 41Bk located at the developing position. The idle gear 204Bk is also mounted on the rear of the revolver rear plate for transmitting the rotation of the above gear 202Bk to the developing roller gear 201Bk affixed to the developing roller 42Bk. The drive gear 203 is mounted on the copier body at a position where the gear 203 is capable of meshing with the gear 202Bk of the subunit 41Bk located at the developing position.

The revolver drive means and developing roller drive means move a desired developing subunit to the developing position, as follows. The revolver motor 101 rotates the developing unit 4*a* and toner storing unit 4*b* in the direction C until a desired developing subunit arrives at the developing position where it faces the drum 1. Then, the subunit develops a latent image formed on the drum 1. Specifically, a controller or drive control means, not shown, controls the drive means such that the developing unit 4*a* first rotates at a substantially constant acceleration rate until it reaches a preselected speed, and then rotates at an acceleration rate opposite in direction to the above acceleration rate (deceleration rate hereinafter) until it stops at the preselected position. The developing unit 4*a* may be decelerated immediately after it has reached the preselected speed, if desired. Further, the developing unit 4*a* after reaching the preselected speed may be rotated at the preselected speed for a preselected period of time and then decelerated.

When the desired developing subunit, e.g., the subunit 41Bk is brought to the developing position, the drive input gear 202Bk of the subunit 41Bk meshes with the drive gear 203. As a result, the output torque of the drive motor mounted on the copier body is transmitted to the developing roller 42Bk via the idle gear 204Bk and developing roller gear 201Bk.

In the illustrative embodiment, the drive gear 203 rotates, on meshing with, e. g., the drive input gear 202Bk, in such a direction that a load acts on the rotation of the developing unit 4*a,* i.e., in the direction counter to the direction of rotation of the developing unit 4*a*. Consequently, the output torque of the drive motor is transferred from the drive gear 203 to the drive input gear meshing therewith in such a manner as to counteract the rotation of the developing unit 4*a*. Therefore, when the developing unit 4*a* is rotated to replace the developing subunit 41Bk after completing development with the next developing unit 41C, a load acts on the developing unit 4*a* so long as the drive gear 203 is held in mesh with any one of the drive input gears 202Bk–202C. Specifically, on the completion of, e.g., development in black, a load acts on the above rotation of the developing unit 4*a* until the drive input gear 2028k has been released from the drive gear 203. Subsequently, immediately before the developing subunit 41C arrives at the developing position and stops there, the drive input gear 202C starts meshing with the drive gear 203, exerting a load on the rotation of the developing unit 4*a*.

Figure 17:
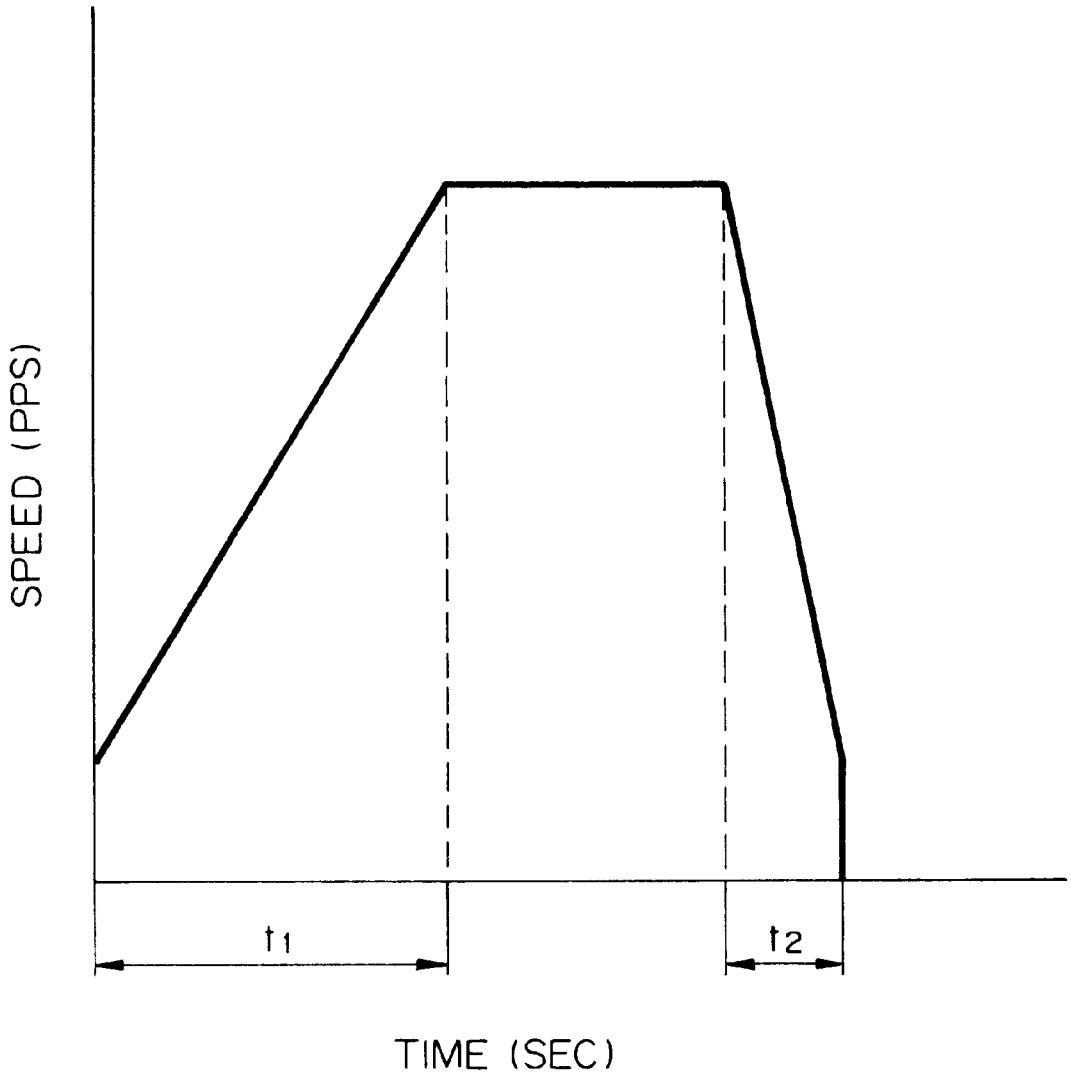
FIG. 17 shows a drive pattern for driving a motor included in the second embodiment.

In the illustrative embodiment, the controller is constructed such that the period of time for deceleration (stop period) up to the stop of the developing unit 4*a* is shorter than the period of time for acceleration (start period) up to the rotation at the preselected speed. Specifically, FIG. 17 shows a pattern for driving the revolver motor 101. As shown, a period of time for deceleration $t_2$ is shorter than a period of time for acceleration $t_1$. The load acting on the drive source assigned to the developing unit and toner storing unit increases in absolute value with an increase in acceleration rate. Therefore, the absolute value of the load acting on the drive source during acceleration decreases relative to the absolute value of the load acting on the drive source during deceleration. Stated another way, the load acting during deceleration increases in absolute value relative to the load acting during acceleration. It should be noted that the load acting during acceleration and the load acting during deceleration are opposite in direction to each other.

However, during deceleration, the output torque of the drive motor, not shown, transmitted via the drive gear 203 and drive input gear 202C meshing with each other acts in the direction counter to the direction of rotation of the developing unit 4*a,* i.e., tends to stop the rotation. It follows that the load acting on the drive source is distributed to the revolver motor 101 and the above drive motor. Consequently, the increase in the absolute value of the load acting on the revolver motor 101 is suppressed. This allows the developing unit 4*a* to be rotated at a high speed, i.e., in a shorter deceleration time while suppressing the load acting on the revolver motor 101.

As stated above, the illustrative embodiment uses the drive force assigned to the developing section, but acting on the rotation of the developing unit 4*a* at the same time. The drive pattern is such that when the above drive force acts in the direction decreasing the load on the revolver motor 101, i.e., during deceleration, the deceleration rate is increased. With this drive pattern, it is possible to increase the rotation speed while obviating defective images ascribable to step-out, the scale-up of motor specifications, and the increase in motor drive power. That is, there can be reduced the color switching time of the revolver type developing device without increasing the cost. The developing device can therefore meet the increasing demand for a higher copying or printing speed.

Figure 18:
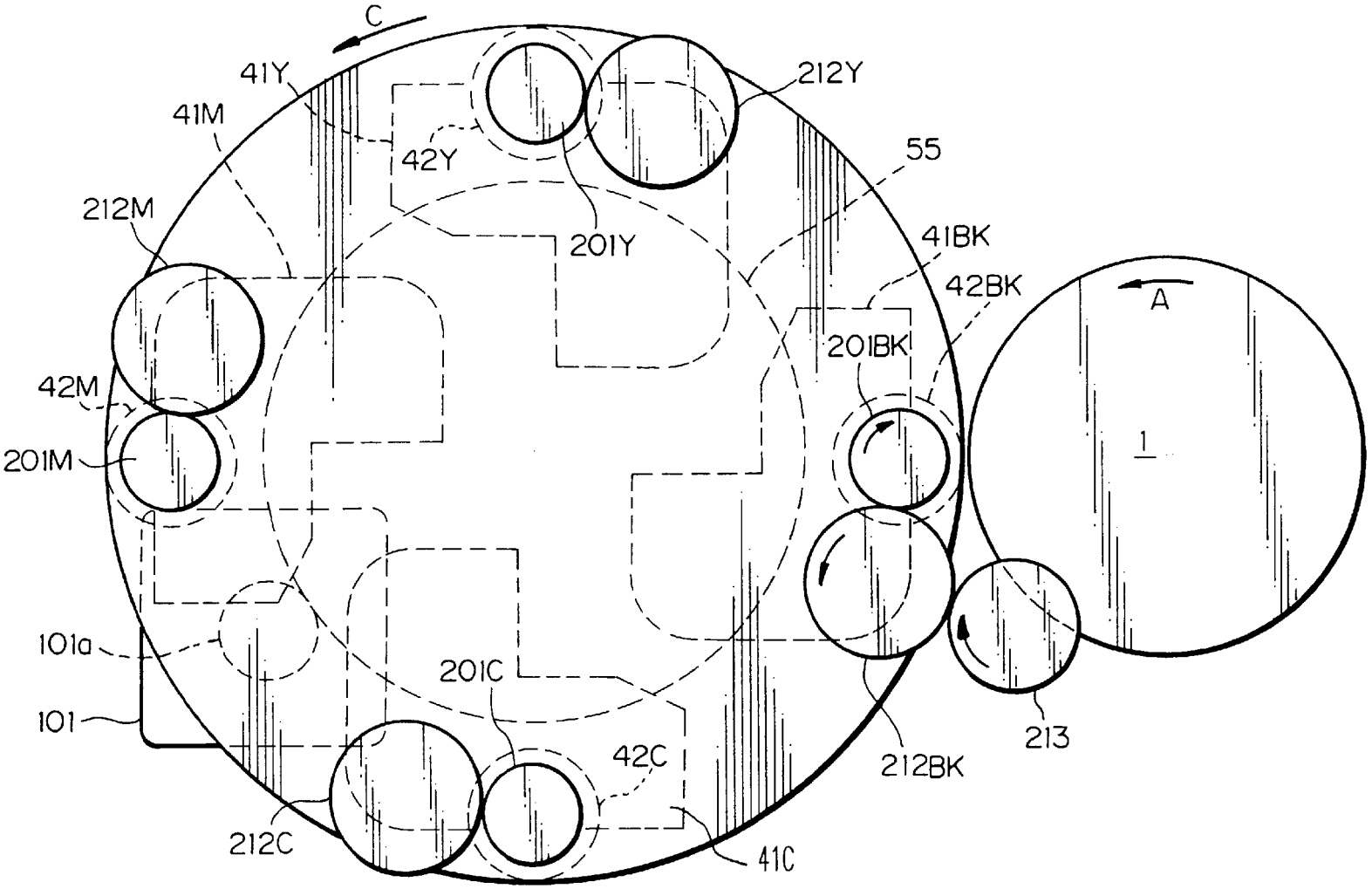
FIG. 18 shows a drive arrangement included in a modified form of the second embodiment.

A modified form of the second embodiment will be described with reference to FIG. 18. Specifically, as shown in FIG. 18, drive input gears 212Bk, 212Y, 212M and 212C and developing roller gears 201Bk 201Y, 201M and 201C are associated with the developing subunits 41Bk, 41Y, 41M and 41C, respectively. A drive gear 213 is mounted on the apparatus body and driven by the developing roller drive motor. The gears are each driven in a particular direction, as indicated by an arrow in FIG. 18. In the developing subunit located at the developing position, e.g., in the black developing subunit 41Bk, the rotation of the drive input gear 212Bk is directly transferred to the developing roller gear 201Bk without the intermediary of an idle gear. The drive gear 213 is rotated in the opposite direction to the drive gear 203 shown in FIG. 16.

In operation, when a desired developing subunit, e.g., the subunit 41Bk is brought to the developing position, the drive input gear 212Bk meshes with the drive gear 213. As a result, the output torque of the developing roller drive motor, not shown, is transmitted to the developing roller gear 201Bk, causing the developing roller 42Bk to rotate.

In this modification, on meshing with, e.g., the drive input gear 212Bk of the subunit 41Bk, the drive gear 213 rotates in such a direction that it helps the developing unit 4*a* rotate, i.e., moves in the same direction as the developing unit 4*a*. As a result, the output torque of the developing roller drive motor is transmitted from the drive gear 213 to the drive input gear 212Bk in the direction promoting the rotation of the developing unit 4*a*. This continues so long as the drive gear 213 remains in mesh with any one of the drive input gears 212Bk–212C and the drive gear 213 rotates at a higher speed than the developing unit 4*a,* at the time when the developing unit 4*a* is rotated for switching the developing subunit. More specifically, at the time of start of the rotation, a force promoting the rotation acts. However, at the time of deceleration, despite that the revolver motor 101 is operated to stop the rotation of the developing unit 4*a,* the drive gear 213 in rotation helps the developing unit 4*a* rotate and therefore exerts a load on the revolver motor 101.

Figure 19:
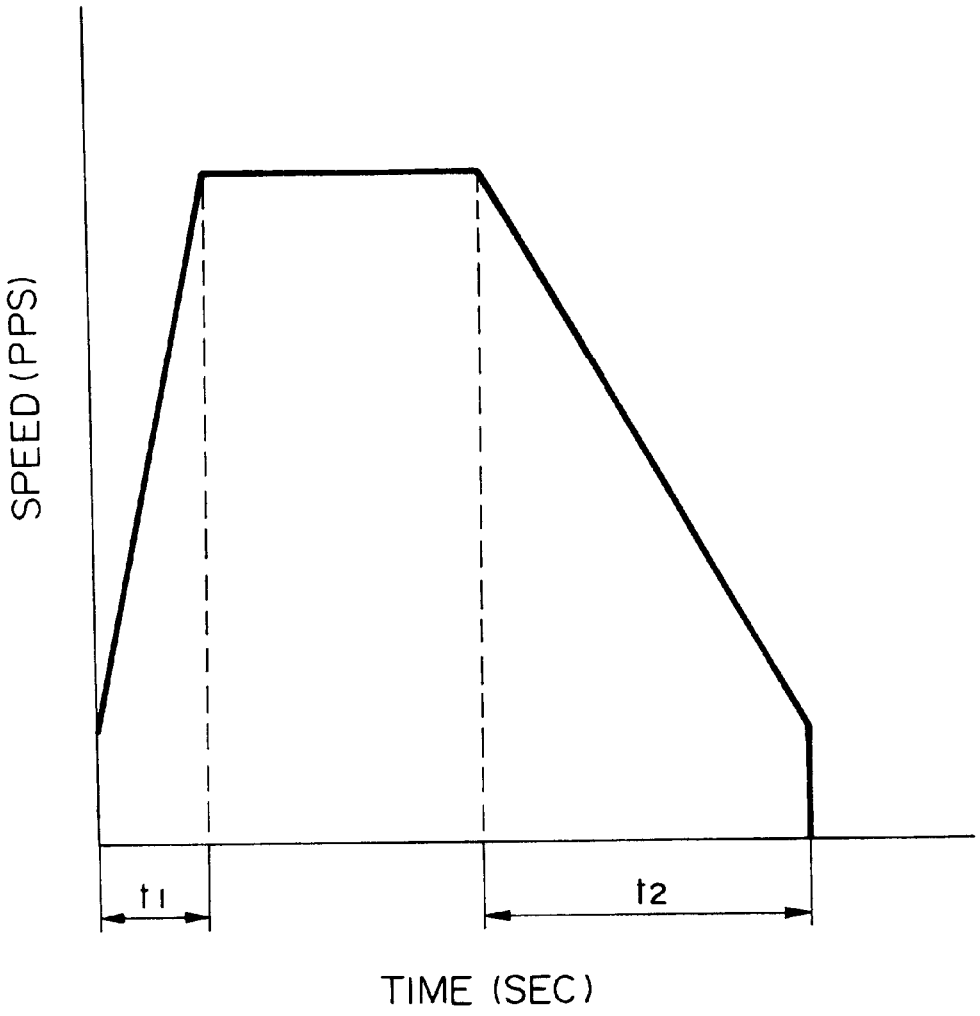
FIG. 19 shows a drive pattern associated with the arrangement of FIG. 18.

In this modification, the controller is constructed such that the period of time for acceleration (start period) up to the rotation at the preselected speed is shorter than the period of time for deceleration (stop period) up to the stop of the developing unit 4*a,* as shown in FIG. 19. As shown, the period of time for acceleration time $t_1$ is shorter than the period of time for deceleration $t_2$, i.e., the deceleration rate is selected to be lower than the acceleration rate. The absolute value of the load acting on the drive source for driving the developing unit and toner storing unit increases with an increase in acceleration rate, as stated earlier. It follows that the absolute value of the load acting on the drive source during deceleration decreases relative to the absolute value of the load acting on the same during acceleration. Stated another way, the load acting during acceleration increases relative to the absolute value of the load acting during deceleration. However, during acceleration, the force of the developing roller drive motor transmitted via the drive gear 213 and drive input gear acts in the direction helping the developing unit 4*a* rotate. Consequently, the load acting on the drive source during acceleration is distributed to the revolver motor 101 and developing roller drive motor. This successfully suppresses an increase in the absolute value of the load acting on the revolver motor 101. It is therefore possible to reduce the acceleration period and therefore to increase the rotation speed while reducing the load acting on the revolver motor 101.

While the developing roller drive motor has been shown and described as driving only the developing roller 42, it may drive any other member included in the developing chamber at the same time, e.g., the first and second screw conveyors 43 and 44.

Figure 20:
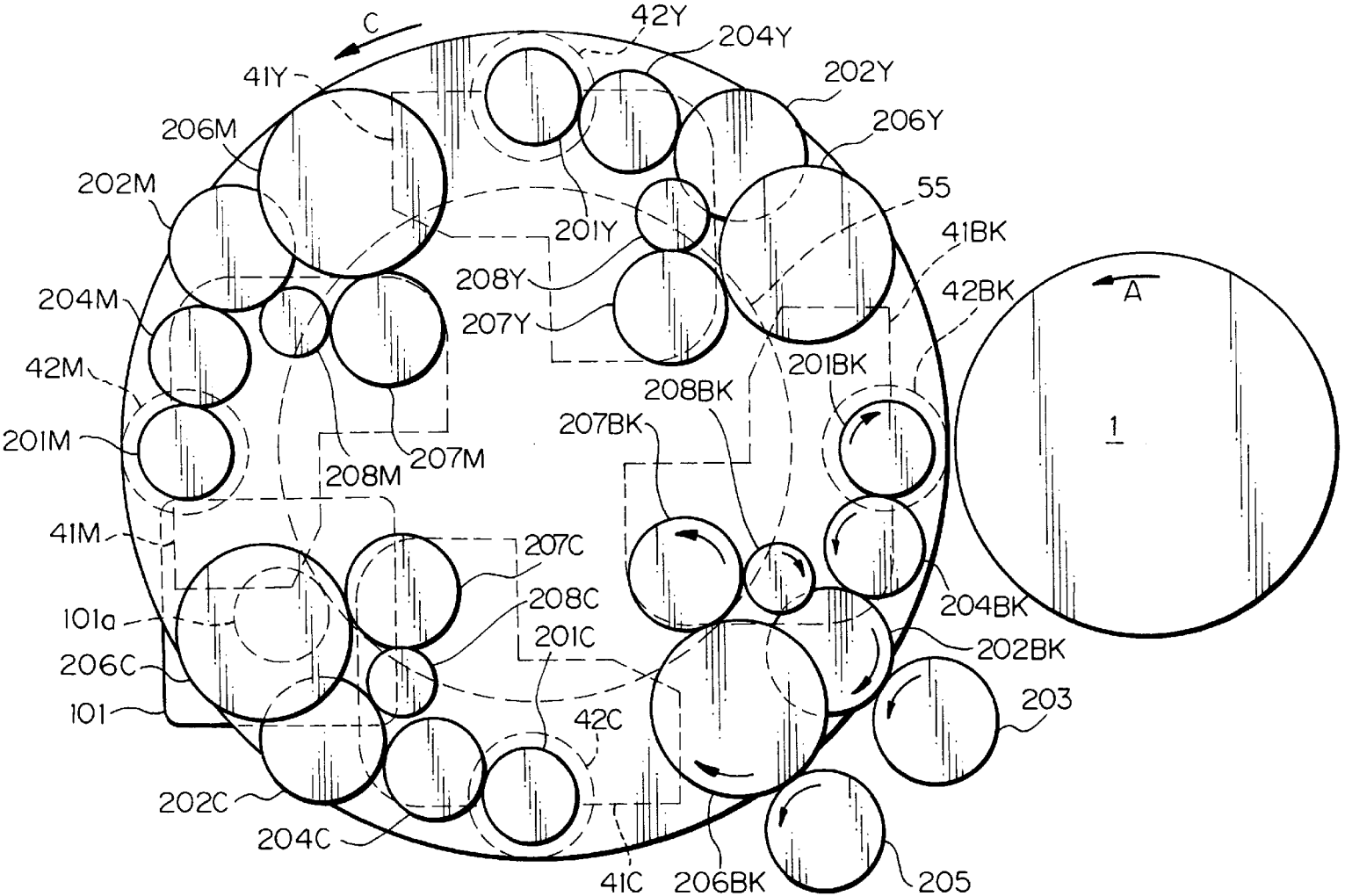
FIGS. 20 and 21 each shows a particular drive arrangement representative of another modification of the second embodiment.
Figure 21:
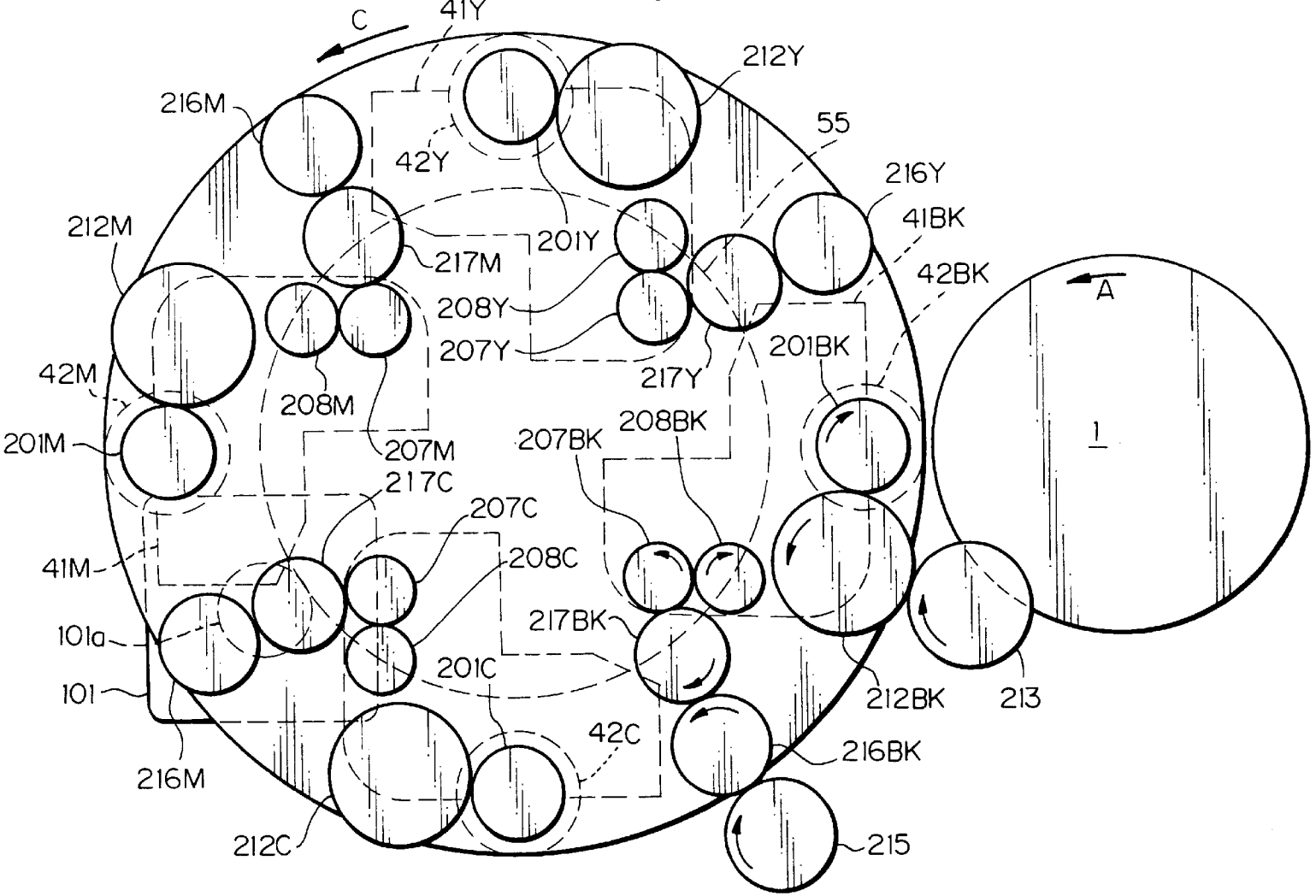

As shown in FIG. 20 or 21, the first and second screw conveyors 43 and 44 may be driven by an exclusive drive source independent of the drive source assigned to the developing roller 42. In FIG. 20, a drive gear 205 assigned to the screw conveyors 43 and 44, like the developing roller drive gear 203, meshes with, e.g., a drive input gear 206Bk associated with the developing chamber brought to the developing position and rotates in the direction in which it exerts a load on the rotation of the developing unit 4*a,* i.e., in the counter direction. The output torque of a screw drive motor, not shown, is transmitted to the drive input gear 206Bk via the drive gear 205 and therefrom to screw gears 207Bk and 208Bk.

In FIG. 21, a drive gear 215 assigned to the screw conveyors 43 and 44, like the drive gear 213, meshes with, e.g., a drive input gear 216Bk associated with the black developing subunit brought to the developing position and rotates in the direction promoting the rotation of the developing unit 4*a,* i.e., in the same direction. The output torque of a screw drive motor, not shown, is transmitted to the drive input gear 216B via the drive gear 215 and therefrom to screw gears 207Bk and 208Bk via an idle gear 217Bk.

Third Embodiment

Figure 23:
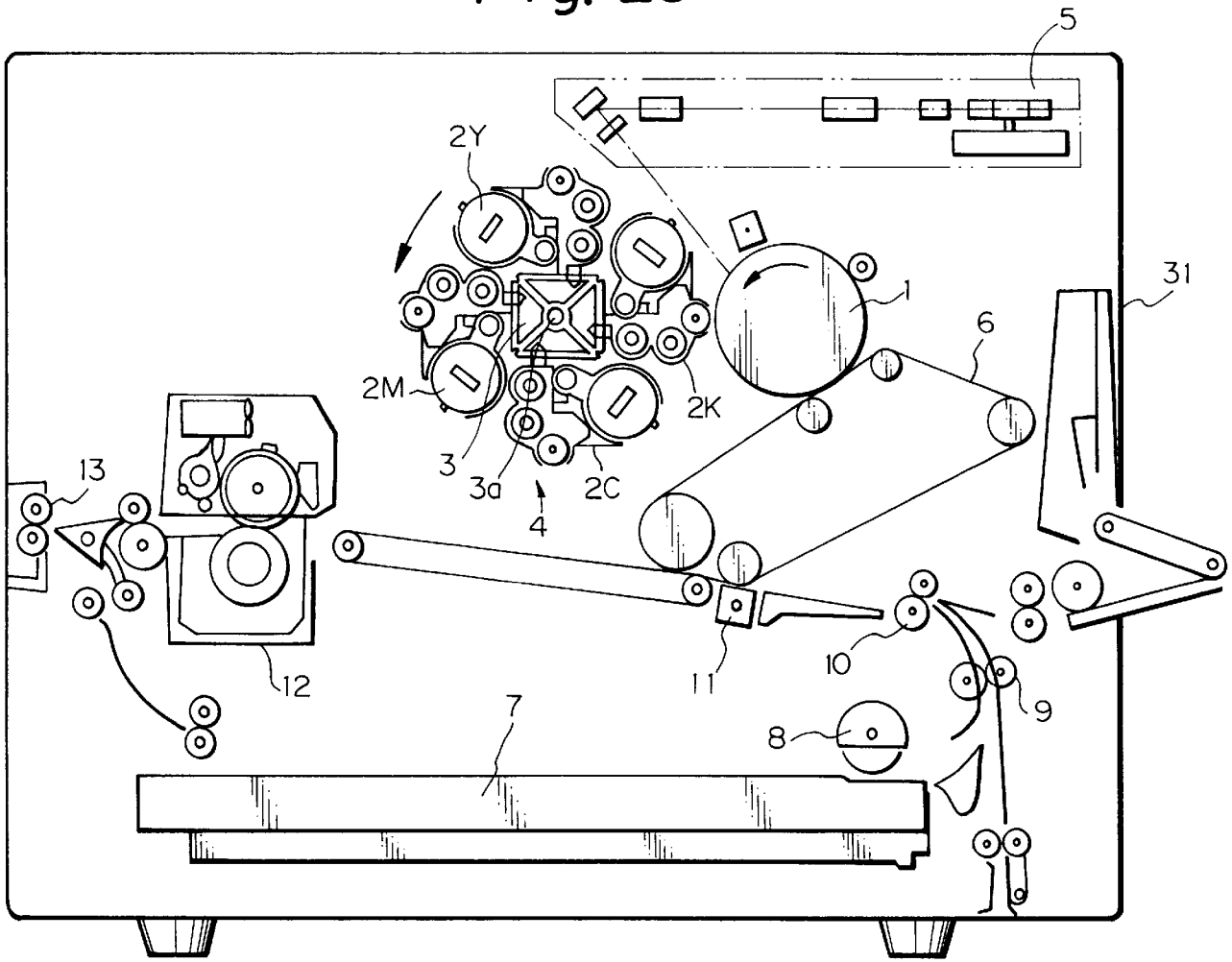
FIG. 23 shows a third embodiment of the image forming apparatus in accordance with the present invention.

Referring to FIG. 23, a printer representative of the third embodiment of the present invention includes the drum or image carrier 1 and a revolver type developing device including a developing unit 4. The developing unit 4 includes four developing subunits 2K (black), 2Y (yellow), 2M (magenta) and 2C (cyan) arranged around a unit support 3. The developing unit 4 is rotatably supported by a center shaft 3*a*.

During a copying operation, optics 5 transforms preselected image information to K, Y, M and C image signals. While the drum 1 is rotated counterclockwise, as viewed in FIG. 23, the optics 5 sequentially scans the drum 1 with a light beam in accordance with the image signals to thereby form latent images. The developing unit 4 is also rotated counterclockwise, as viewed in FIG. 23. When the developing unit 4 is rotated to bring any one of the developing subunits 2K–2C to a developing position where the subunit faces the drum 1, the subunit develops a latent image formed on the drum 1 and thereby produces a corresponding toner image. In FIG. 23, the subunit 2K is shown as being located at the developing position. The toner image is transferred from the drum 1 to an intermediate transfer belt 6 (primary transfer hereinafter). Toner images of different colors sequentially formed on the drum 1 are sequentially transferred to the belt 6 one above the other, forming a full-color image.

A paper is fed from a paper tray 7 toward a registration roller 10 by a pick-up roller 8 and an intermediate roller 9. The registration roller 10 straightens the leading edge of the paper and then drives the paper to a position below the belt 6 such that the leading edge of the paper meets the leading edge of the full-color image carried on the belt 6. As soon as the paper meets the full-color image, a corotron charger 11 transfers the image to the paper by corona discharge (secondary transfer). A fixing unit 12 fixes the image on the paper by using heat and pressure. The paper with the fixed image, i.e., a full-color printing is driven out of the printer to a tray by an outlet roller 13.

Figure 24:
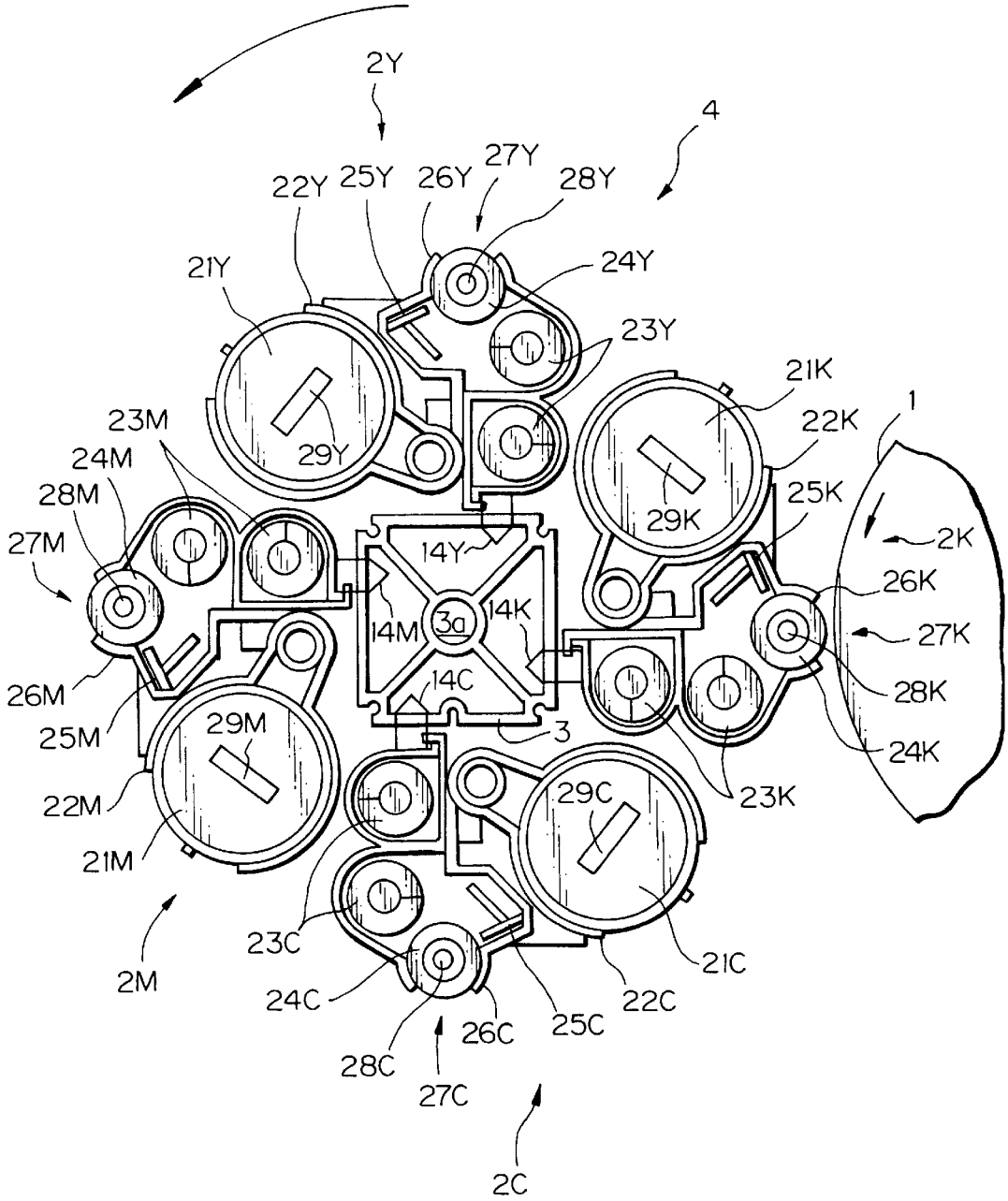
FIG. 24 shows a developing unit included in the third embodiment.

FIG. 24 shows the developing unit 4 in detail. As shown, the developing subunits 2K–2C are arranged around the unit support 3 at the intervals of 90°. Locking members 14K, 14Y, 14M and 14C respectively protrude from the developing subunits 2K, 2Y, 2M and 2C, and each is received in a particular portion of the unit support 3. In this condition, the subunits 2K–2C are removably mounted to the unit support 3. Each of the subunits 2K–2C can be removed from the unit support 3 only when it is brought to a position 45° off to the upper right of the center shaft 3*a*, as will be described specifically later.

The developing subunits 2K–2C mounted to the unit support 3 constitute the developing unit 4 bodily rotatable about the center shaft 3*a*. When the developing unit 4 rotates, the subunits 2K–2C revolve around the center shaft 3*a*.

In the specific condition shown in FIG. 24, the developing subunit 2K storing black toner is located at the developing position. The other subunits 2Y, 2M and 2C respectively storing yellow toner, magenta toner and cyan toner sequentially follow the subunit 2K in the counterclockwise direction. The subunits 2K–2C are identical in construction with each other. The following description will concentrate on the subunit 2K. The structural elements of the other subunits 2Y, 2M and 2C are distinguished from the structural elements of the subunit 2K by suffixes Y, M and C attached to the reference numerals.

The subunit 2K includes a guide 22K for holding a toner container 21K, two agitators 23K implemented as screws, a developing roller 24K, a doctor blade 25K, and a casing 26K accommodating such structural elements. An opening 27K is formed in the casing 26K and extends along the nip portion of the developing roller 24K.

In operation, when the subunit 2K is brought to the developing position, the opening 27K faces the drum 1. The toner deposited on the developing roller 24K exposed to the outside via the opening 27K is transferred to the drum 1 so as to develop a latent image formed on the drum 1. The operator may remove the toner container 21K from the guide 22K by holding a knob 29K and turning the container 21K.

Figure 25:
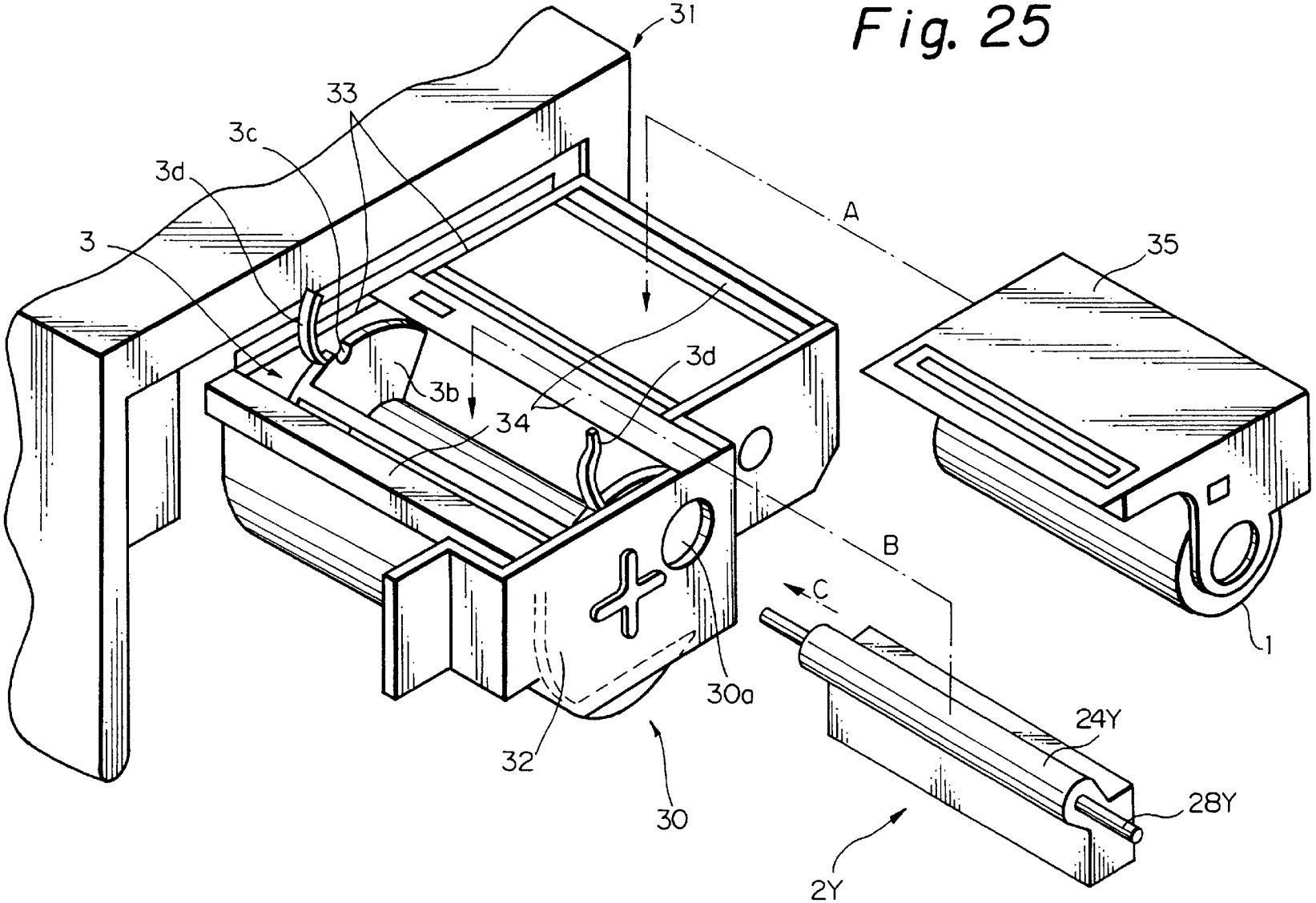
FIG. 25 is a perspective view showing a holder for supporting the developing unit of FIG. 24 and a photoconductive drum.

The developing unit 4 and drum 1 are positioned side by side in the printer. In the illustrative embodiment, as shown in FIG. 25, the developing unit 4 and drum 1 are supported by a single holder 30 together. The holder 30 can be easily pulled out of the printer body, labeled 31, for facilitating, e.g., maintenance.

FIG. 25 shows the holder 30 pulled out of the printer body 31. The holder 30 includes a front plate 32, a rear plate 33, and stays 34 connecting the front plate 32 and rear plate 33. The front plate 32 and rear plate 33 support the unit support 3 forming a part of the developing unit 4. Disks 3*b* are mounted on opposite ends of the unit support 3 for mounting the subunits 2K–2C.

A drum unit 35 loaded with the drum 1 is mounted to the holder 30 at the upper right side of the stay 34 located at the center, as indicated by a dash-and-dot line A in FIG. 25. The subunit 2Y is mounted to the unit support 3, as indicated by a dash-and-dot line B in FIG. 25. At this stage, the subunit 2Y is not loaded with the toner container 21Y.

The locking member 14Y protruding from the rear of the subunit 2Y mates with the unit support 3, as stated earlier with reference to FIG. 24. As shown in FIG. 25, at a position outward of the locking member 14Y, the shaft 28Y of the developing roller 24Y included in the subunit 2Y is received in a notch 3*c* formed in the circumferential edge of the disk 3*b* and retained by a retainer 3*d*. In this manner, the subunit 2Y is accurately positioned on the unit support 3. The other subunits 2K, 2M and 2C each is mounted to the unit support 3 by turning the developing unit 4 by each 90°.

Figure 26:
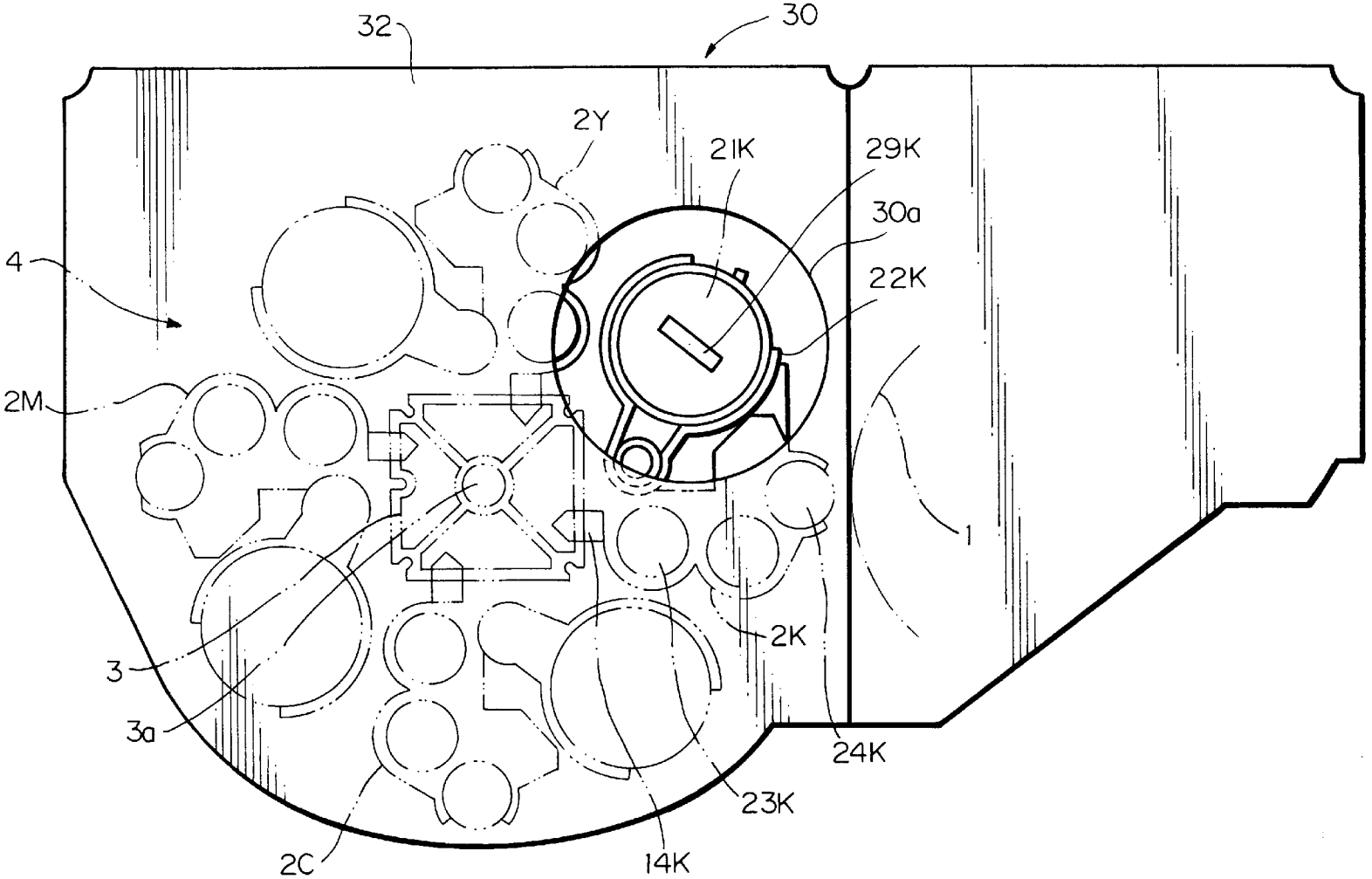
FIG. 26 is a side elevation of the holder.

An opening 30*a* is formed in the front plate 32 for allowing any one of the toner containers 21K–21C to be replaced therethrough FIG. 26 shows a relation between the opening 30*a* the subunits 2K–2C, as seen in a direction 0. As shown, the opening 30*a* is positioned at substantially the center of the front plate 32. In the specific condition shown in FIG. 26, the toner container 21K is ready to be removed from the subunit 2K located at the developing position.

The toner container 21K has a hollow cylindrical configuration. To mount a new toner container 21K, the operator inserts it into the guide 22K in the axial direction. Then, the operator turns the toner container 21K clockwise, as viewed in FIG. 26, by gripping the knob 29K. As a result, the toner container 21K is locked to the guide 22K. By turning the toner container 21K counterclockwise, the operator can remove it from the guide 22K.

Figure 27:
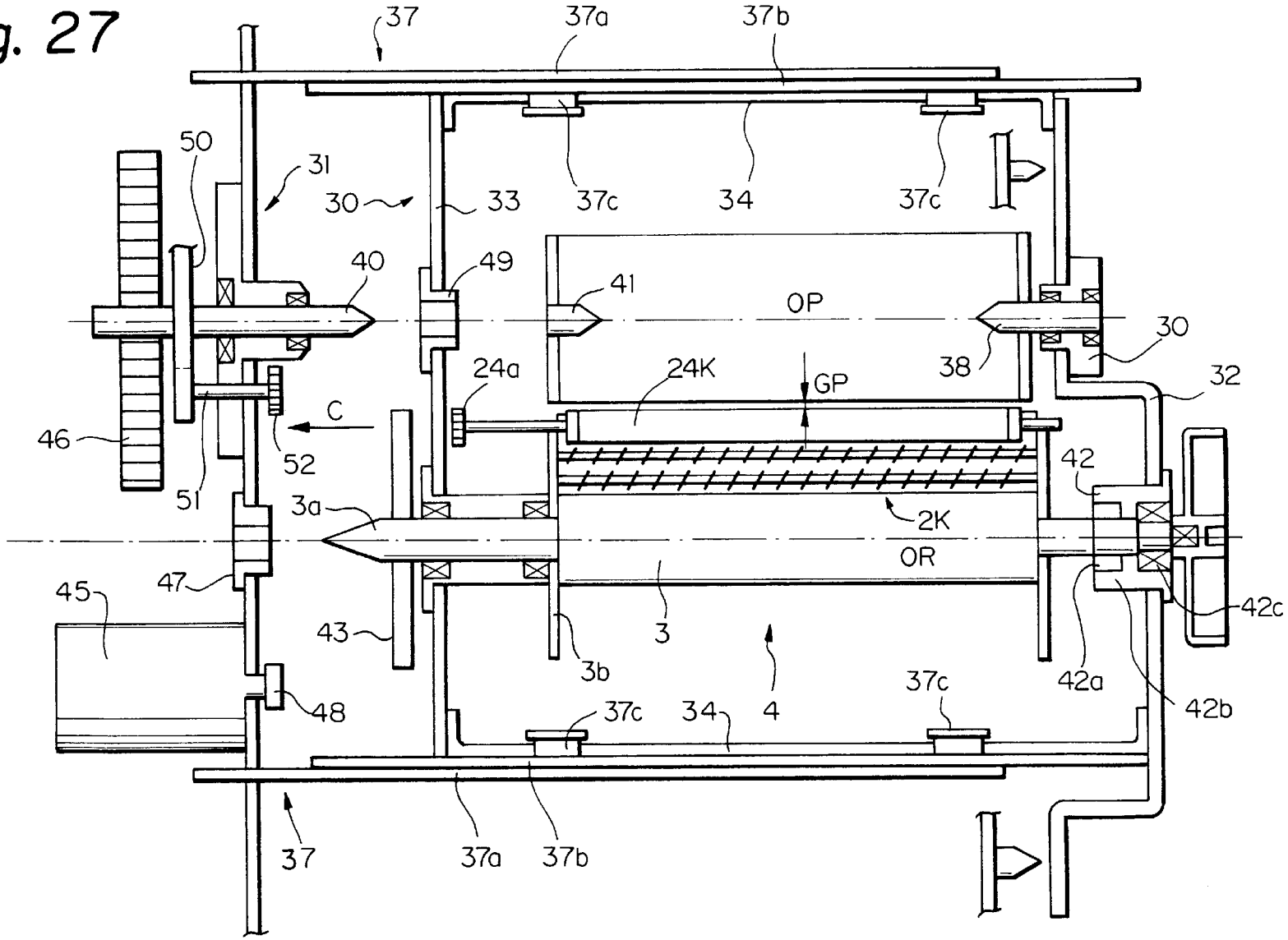
FIG. 27 is a top view showing the connection of the holder and an apparatus body and the details of the holder.

FIG. 27 shows an arrangement for connecting the holder 30 to the printer body 30 and the detailed configuration of the holder 31. In FIG. 27, the holder 30 is shown in its position slightly pulled out of the printer body 31; only the right and left stays 34 are shown. As shown, a mechanism for allowing the holder 30 to be slid out of the printer body 31 includes two two-step slide rails 37 mounted on opposite sides of the holder 30. The slide rails 37 each is made up of a rail 37*a* mounted on the printer body 31 and a rail 37*b* mounted on the holder 30 and engaged with the rail 37*a*. A boss 37*c* is studded on each rail 37*b* while the right or left stay 34 is engaged with the head portion of the boss 37*c*. In this construction, the holder 30 is slidable into and out of the printer body 31.

A shaft 38 protrudes from one end of the drum 1 on the axis of rotation OP of the drum 1 and is supported by a ball bearing 39 mounted on the front plate 32. A bore 41 is formed in the other end of the drum 1 for mating with a drum drive shaft 40 protruding from the printer body 31.

The developing unit 4 (only the subunit 2K facing the drum 1 is shown in FIG. 27) has an axis of rotation OR. The center shaft 3*a* of the developing unit 4 positioned on the axis OR has its front end supported by a bearing 42 mounted on the front plate 32. The rear end of the developing unit 4 adjoining the printer body 31 and provided with a revolver gear 43 is supported by a ball bearing mounted on the rear plate 33.

When the holder 30 is fully slid into the printer body 31, a driven section mounted on the holder 30 and including the revolver gear 43 is operatively connected to a drive section mounted on the printer body 31 and including a stepping motor 45 and a drum drive gear 46. Specifically, when the holder 31 is slid in the direction C, FIG. 25, the center shaft 3*a* of the revolver gear 43 is supported by a slide bearing 47 mounted on the printer body 31. At the same time, the revolver gear 43 is brought into mesh with a revolver drive gear 48 mounted on the output shaft of the stepping motor 45 affixed to the printer body 31. The drum drive shaft 40 extends throughout a slide shaft 49 mounted on the rear plate 33 with its end mating with the bore 41 of the drum 1, thereby supporting the drum 1. Further, a drive input gear 24*a* mounted on the rear end of the shaft 28K of the developing roller 24K is brought into mesh with a drive gear 52 mounted on the end of a clutch 51. A timing belt 50 mounted on the printer body 31 transfers a drive force to the clutch 51 in order to rotate the developing roller 24K.

As stated above, the holder 30 supports one end of the center shaft 3*a* of the developing unit 4 and one end of the shaft 38 of the drum 1 with a single front plate 32 and supports the other ends of the same with a single rear plate 33. The front plate 32 and rear plate 33 are connected together by the stays 34. With such a simple construction, the holder 30 is capable of maintaining the axis of the drum 1 and the axis OR of the developing unit 4 parallel to each other at a preselected distance and insuring an accurate gap GP for development.

Figure 28B:
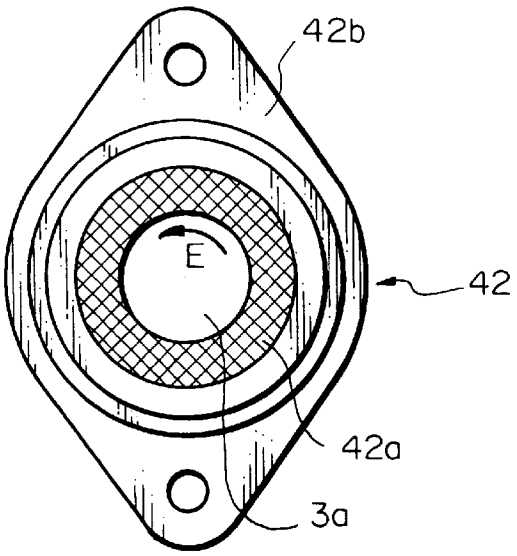
FIG. 28B is a plan view of the bearing of FIG. 28A.
Figure 28A:
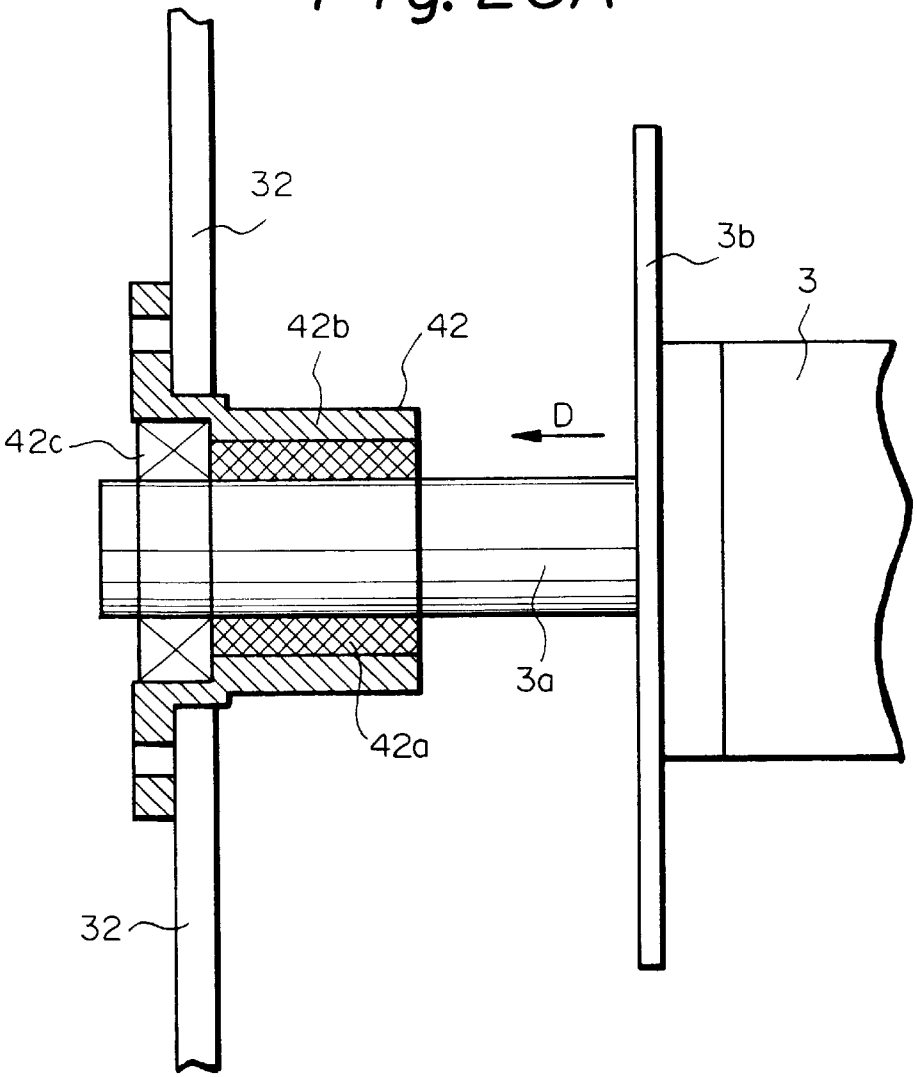
FIG. 28A is a section showing a bearing included in the developing unit of the third embodiment and including a one-way clutch.

Further, a one-way clutch 42*a* is mounted on the center shaft 3*a* of the developing unit 4 so as to allow the developing unit 4 to rotate only in one direction. FIGS. 28A and 28B show the one-way clutch 42*a* specifically. As shown, the one-way clutch 42*a* is received in a bearing holder 42*b* together with a ball bearing 42*c* supporting the center shaft 3*a*. The bearing holder 42*b* is mounted on the front plate 32. FIG. 28B shows the bearing 42 as seen in a direction indicated by an arrow D in FIG. 28A. The bearing holder 42*b* with the one-way clutch 42*a* is press-fitted in the front plate 32 and then firmly fixed in place at two points on the center line. The one-way clutch 42*a* physically limits the rotation of the center shaft 3*a* in a direction indicated by an arrow E. The developing unit 4 is therefore rotatable only in the counterclockwise direction, as seen from the front.

As stated above, the one-way clutch 42*a* received in the bearing 42 can be readily joined with the front plate 32 and center shaft 3*a* and does not effect the layout of surrounding image forming units in the holder 30. The one-way clutch 42*a* may also be mounted on the rear plate 33 for supporting the center shaft 3*a* if allowable from the cost standpoint. This prevents the center shaft 3*a* from twisting, compared to the case wherein the clutch 42*a* is mounted only on the front plate 32.

When the developing unit 4 is driven by the stepping motor 45, it brings any one of the developing subunits 2K–2C to the developing position. The subunit located at the developing position develops a latent image formed on the drum 1. During development, the developing unit 4 must be locked in place and is locked by the turn-on of the stepping motor 45 also.

While the developing unit 4 is locked in place by the stepping motor 45 during development, small play is not avoidable due to backlash between the revolver drive gear 48 and the revolver gear 43. The developing unit 4 therefore has play in the direction of rotation. The one-way clutch 42*a* shifts the above play in the direction of rotation and thereby removes it substantially at the same time as the start of development, thereby fully locking the developing unit 4.

In this manner, the one-way clutch 42*a* limits the direction of rotation of the developing device 4 and thereby allows each of the subunits 2K–2C to be surely locked in place at the developing position. The printer is therefore free from defective images pitching in the horizontal direction due to the reciprocating oscillation of the developing unit 4.

Generally, when the printer is not in operation, e.g., when a power switch provided on the printer body is turned off for maintenance, the developing unit 4 remains stationary at a position rotated about 45° away from the operating position shown in FIG. 24. In this condition, the developing device 4 tends to rotate in the direction opposite to the direction of rotation for development (reverse rotation hereinafter) due to the positional relation between the relatively heavy developing rollers. That is, the center of gravity of the developing unit 4 at the time of maintenance is set such that a moment opposite in direction to the rotation for development acts on the developing unit 4. As a result, the above reverse rotation occurs when the revolver drive gear 48 and revolver gear 43 are released form each other after the holder 30 has been pulled out of the printer body 31.

The developing device 4 with the one-way clutch 42*a* is free from the above reverse rotation. This prevents the operator's fingers from being caught by the printer due to the sudden reverse rotation of the developing unit 4 and protects the drum 1 from damage.

Further, as shown in FIG. 26, the developing unit 4 with the one-way clutch 42*a* causes toner container 21K located at the replacing position to be rotated (clockwise) in the direction opposite to the direction of rotation of the developing unit 4 for image formation (counterclockwise). Such a rotation of the toner container 21K is equivalent in direction to the operation of the one-way clutch 42*a*. The operator can therefore easily affix a new toner container 21K with the developing unit 4 surely remaining stationary. The replacement of the toner container 21K is therefore easy to perform.

In the illustrative embodiment, the position for the replacement of the toner container lies in the range rightward of the center shaft 3*a*, as viewed in FIG. 26. The above ranges refers to a range closer to the path along which the circumference of the developing unit 4 moves from the bottom in the perpendicular direction toward the top in the same direction than the perpendicular plane containing the axis of the developing unit 4. When the operator inserts or pulls out the toner container, the above configuration allows the one-way clutch 42*a* to prevent the developing unit 4 from rotating in the direction opposite to the direction for image formation (clockwise, FIG. 26). This further facilitates the replacement of the toner container.

While the embodiments shown and described have concentrated on a color printer, the present invention is, of course, similarly applicable to any other image forming apparatus, e.g., a copier or a facsimile apparatus so long as the apparatus includes a plurality of developing units.

In summary, it will be seen that the present invention provides an image forming apparatus having various unprecedented advantages, as enumerated below.

(1) At the time of replacement of a developer container, there is obviated an occurrence that a developing unit rotates due to an unexpected change in a voltage or a current driving a stepping motor. The operator can therefore surely replace the developer container without toner falling via a gap or without dropping the container itself.

(2) The apparatus needs no extra power and therefore contributes to energy saving. In addition, the apparatus reduces the cost because it does not need a solenoid or similar extra part.

(3) A drive force for driving an image forming member and acting on the rotation of a rotary support body is used to increase the acceleration rate of the support body when the support body rotates in a direction in which a load on a drive source decreases. It is therefore possible to obviate the step-out of the drive means and therefore to cope with heavy loads and high speed operation without increasing the cost or sophisticating the construction. In addition, the apparatus saves energy.

(4) Play of the developing unit in the direction of rotation is shifted and thereby eliminated during development. This obviates defective images ascribable to the fine oscillation of the developing unit and thereby insures high image quality.

(5) The developing unit is easy to maintain.

(6) When the operator pulls out the image carrier and developing unit out of the apparatus body, there can be obviated an occurrence that the apparatus body catches the operator's hand or damages the image carrier. The apparatus therefore promotes safe operation and easy maintenance.

Various modifications will become possible for those skilled in the art after receiving the teachings of the present disclosure without departing from the scope thereof.

What is claimed is:

1. An image forming apparatus comprising:

a developing unit rotatably supported by a body of said image forming apparatus and including a plurality of developing subunits and a plurality of replaceable developer containers each storing a developer to be replenished to a particular one of said plurality of developing subunits;

a stepping motor configured to cause said developing unit to rotate in order to bring any one of said plurality of developing subunits to a developing position;

a preventing mechanism configured to prevent said developing unit from rotating at a time of replacement of any one of said plurality of developer containers due to an unexpected change in a voltage or a current driving said stepping motor;

a locking portion included in either one of said developing unit and said body and an engaging portion included in the other of said developing unit and said body, said locking portion and said engaging portion selectively engaging with each other for preventing said developing unit from rotating;

a door member opened when any one of said developer containers is to be removed from said apparatus or closed when development is under way, said locking portion and said engaging portion engaging with each other in mechanically interlocked relation to an opening movement of said door member; and a moving device configured to cause said locking portion to engage with said engaging portion by mechanically interlocking the opening movement of said door member to a movement of said locking portion.

2. An apparatus as claimed in claim 1, wherein said locking portion comprises a plunger of a solenoid, said solenoid being selectively turned on to lock said developing unit or turned off to unlock said developing unit.

3. An apparatus as claimed in claim 1, further comprising:

a biasing member constantly biasing said locking portion toward said engaging portion; and a moving mechanism configured to move, when said door member is closed, said locking portion away from said engaging portion against an action of said biasing member.

4. An image forming apparatus comprising:

a plurality of developing subunits;

a rotary support body rotatable while supporting said plurality of developing subunits, for bringing any one of said plurality of developing subunits to a preselected developing position facing an image carrier;

first drive means for causing said rotary support body to rotate;

drive control means for controlling said first drive means such that said rotary support body rotates for locating any one of said plurality of developing subunits at said developing position while being accelerated until said rotary support body reaches a preselected speed, and is then decelerated to a stop to thereby locate the one developing subunit at said developing position; and second drive means for meshing with a drive input gear included in said one developing subunit located at said developing position to thereby transmit a drive force to an image forming member included in said one developing subunit, said drive force being transmitted to said drive input gear in a direction counter to a direction of rotation of said rotary support body;

wherein an interval between a time when said rotary support body rotating at said preselected speed begins to be decelerated and a time when said rotary support body stops rotating is shorter than an interval between a time when said rotary support body held in a halt begins to move and a time when said rotary support body reaches said preselected speed.

5. An image forming apparatus comprising:

a plurality of developing subunits;

a rotary support body rotatable while supporting said plurality of developing subunits, for bringing any one of said plurality of developing subunits to a preselected developing position facing an image carrier;

first drive means for causing said rotary support body to rotate;

drive control means for controlling said first drive means such that said rotary support body rotates for locating any one of said plurality of developing subunits at said developing position while being accelerated until said rotary support body reaches a preselected speed, and is then decelerated to a stop to thereby locate the one developing subunit at said developing position; and second drive means for meshing with a drive input gear included in said one developing subunit located at said developing position to thereby transmit a drive force to an image forming member included in said one developing subunit, said drive force being transmitted to said drive input gear in a direction conforming to a direction of rotation of said rotary support body;

wherein an interval between a time when said rotary support body held in a halt begins to rotate and a time when said rotary support body reaches said preselected speed is shorter than an interval between a time when said rotary support body rotating at said preselected speed begins to be decelerated and a time when said rotary support body stops rotating.

6. An image forming apparatus comprising:

an image carrier rotatable in one direction;

a developing unit rotatable about a center shaft thereof and including a plurality of developing subunits arranged around said center shaft, wherein said developing unit is rotated in a preselected direction for locating any one of said developing subunits at a preselected developing position facing said image carrier to thereby develop a latent image formed on said image carrier; and a one-way clutch mounted on said center shaft of said developing unit for preventing said developing unit from rotating in a direction opposite to said preselected direction, wherein a center of gravity of said developing unit at a time of replacement is selected such that a moment opposite to said preselected direction assigned to said developing unit acts.

7. An apparatus as claimed in claim 6, further comprising a plurality of developer containers removably mounted to said developing unit, wherein any one of said developer containers is replaced at a position lying in a range closer to a path along which a circumference of said developing unit moves from a bottom in a perpendicular direction toward a top in the perpendicular direction than a perpendicular plane containing an axis of rotation of said developing unit.

8. An apparatus as claimed in claim 7, wherein a drive source configured to drive said developing unit comprises a stepping motor which locks said developing unit in position when turned on.

9. An apparatus as claimed in claim 7, wherein an axis of rotation of said image carrier and the axis of rotation of said developing unit are parallel and spaced from each other by a preselected distance, and wherein axially opposite ends of said image carrier and axially opposite ends of said developing unit are supported by a front plate and a rear plate connected to each other by stays, whereby said image carrier and said developing unit are capable of being pulled out of a body of said apparatus integrally with each other.

10. An apparatus as claimed in claim 7, wherein said developer containers each are mounted or dismounted by being rotated about an axis thereof, and wherein said developer containers each are rotated in a direction opposite to said preselected direction of rotation of said developing unit when mounted.

11. An apparatus as claimed in claim 10, wherein a drive source configured to drive said developing unit comprises a stepping motor which locks said developing unit in position when turned on.

12. An apparatus as claimed in claim 10, wherein an axis of rotation of said image carrier and the axis of rotation of said developing unit are parallel and spaced from each other by a preselected distance, and wherein axially opposite ends of said image carrier and axially opposite ends of said developing unit are supported by a front plate and a rear plate connected to each other by stays, whereby said image carrier and said developing unit are capable of being pulled out of a body of said apparatus integrally with each other.

13. An apparatus as claimed in claim 6, wherein a drive source configured to drive said developing unit comprises a stepping motor which locks said developing unit in position when turned on.

14. An apparatus as claimed in claim 6, wherein an axis of rotation of said image carrier and the axis of rotation of said developing unit are parallel and spaced from each other by a preselected distance, and wherein axially opposite ends of said image carrier and axially opposite ends of said developing unit are supported by a front plate and a rear plate connected to each other by stays, whereby said image carrier and said developing unit are capable of being pulled out of a body of said apparatus integrally with each other.

15. An image forming apparatus comprising:

a plurality of developing subunits;

a rotary support body rotatable while supporting said plurality of developing subunits, for bringing any one of said plurality of developing subunits to a preselected developing position facing an image carrier;

a first drive mechanism configured to cause said rotary support body to rotate;

a drive control mechanism configured to control said first drive mechanism such that said rotary support body rotates for locating any one of said plurality of developing subunits at said developing position while being accelerated until said rotary support body reaches a preselected speed, and is then decelerated to a stop to thereby locate the one developing subunit at said developing position; and a second drive mechanism configured to mesh with a drive input gear included in said one developing subunit located at said developing position to thereby transmit a drive force to an image forming member included in said one developing subunit, said drive force being transmitted to said drive input gear in a direction counter to a direction of rotation of said rotary support body, wherein an interval between a time when said rotary support body rotating at said preselected speed begins to be decelerated and a time when said rotary support body stops rotating is shorter than an interval between a time when said rotary support body held in a halt begins to move and a time when said rotary support body reaches said preselected speed.

16. An image forming apparatus comprising:

a plurality of developing subunits;

a rotary support body rotatable while supporting said plurality of developing subunits, for bringing any one of said plurality of developing subunits to a preselected developing position facing an image carrier;

a first drive mechanism configured to cause said rotary support body to rotate;

a drive control mechanism configured to control said first drive mechanism such that said rotary support body rotates for locating any one of said plurality of developing subunits at said developing position while being accelerated until said rotary support body reaches a preselected speed, and is then decelerated to a stop to thereby locate the one developing subunit at said developing position; and a second drive mechanism configured to mesh with a drive input gear included in said one developing subunit located at said developing position to thereby transmit a drive force to an image forming member included in said one developing subunit, said drive force being transmitted to said drive input gear in a direction counter to a direction of rotation of said rotary support body, wherein an interval between a time when said rotary support body held in a halt begins to rotate and a time when said rotary support body reaches said preselected speed is shorter than an interval between a time when said rotary support body rotating at said preselected speed begins to be decelerated and a time when said rotary support body stops rotating.

* * * * *